US011614696B2

(12) United States Patent
Yamada et al.

(10) Patent No.: US 11,614,696 B2
(45) Date of Patent: Mar. 28, 2023

(54) IMAGE FORMATION APPARATUS FOR FORMING IMAGE USING METALLIC DEVELOPER AND SUBLIMATION DYEING DEVELOPER AND METHOD OF PRODUCING COLORING MEDIUM USING SAME

(71) Applicant: Oki Data Corporation, Tokyo (JP)

(72) Inventors: Shin Yamada, Tokyo (JP); Takeshi Kojima, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 111 days.

(21) Appl. No.: 17/151,213

(22) Filed: Jan. 18, 2021

(65) Prior Publication Data

US 2021/0240098 A1 Aug. 5, 2021

(30) Foreign Application Priority Data

Jan. 30, 2020 (JP) ..... JP2020-013820

(51) Int. Cl.

| | |
|---|---|
| ***G03G 15/01*** | (2006.01) |
| ***G03G 15/22*** | (2006.01) |
| ***B41M 5/382*** | (2006.01) |
| ***G03G 9/087*** | (2006.01) |
| ***G03G 9/09*** | (2006.01) |

(52) U.S. Cl.

CPC ..... *G03G 15/0189* (2013.01); *B41M 5/382* (2013.01); *G03G 15/22* (2013.01); *G03G 9/08755* (2013.01); *G03G 9/0906* (2013.01); *G03G 2215/0122* (2013.01)

(58) Field of Classification Search

CPC ..... G03G 15/0189; G03G 15/22; G03G 9/08755; G03G 9/0906; G03G 2215/0122; B41M 5/382

See application file for complete search history.

(56) References Cited

U.S. PATENT DOCUMENTS

| | | | | |
|---|---|---|---|---|
| 2004/0038145 | A1* | 2/2004 | Xu | G03G 13/20 347/112 |
| 2018/0052421 | A1* | 2/2018 | Josiah | G03G 15/6585 |
| 2019/0033745 | A1* | 1/2019 | Takino | G03G 15/6591 |

FOREIGN PATENT DOCUMENTS

| | | |
|---|---|---|
| JP | 2020-181025 A | 11/2020 |

* cited by examiner

*Primary Examiner* — Joseph S Wong

(74) *Attorney, Agent, or Firm* — Metrolex IP Law Group, PLLC

(57) ABSTRACT

An image formation apparatus according to an embodiment may include: a first image formation section configured to form a first image of a developer containing a lustrous pigment; a second image formation section configured to form a second image of a dyeing developer; and a transfer section configured to transfer the first image and the second image on a medium such that the first image and the second image are stacked to each other on the medium.

16 Claims, 21 Drawing Sheets

FIG. 3A
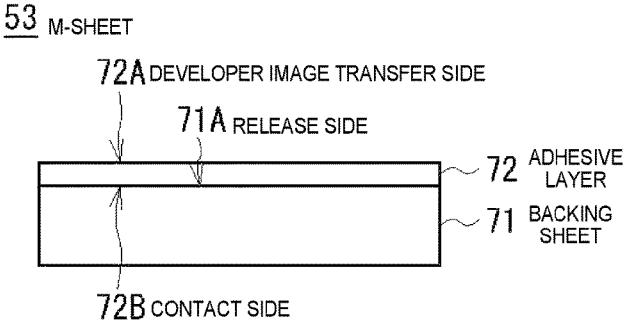
FIG. 3B
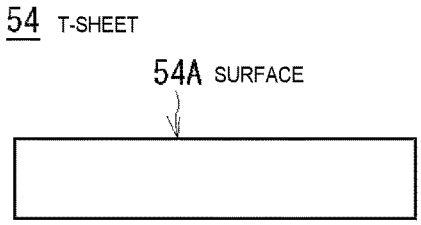
FIG. 4A
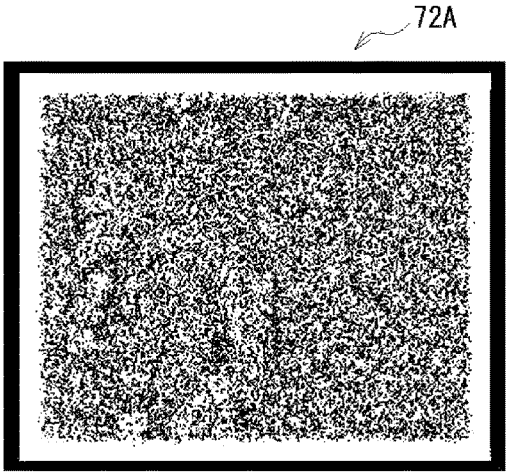
DEVELOPER TRANSFER SIDE OF ADHESIVE LAYER
FIG. 4B
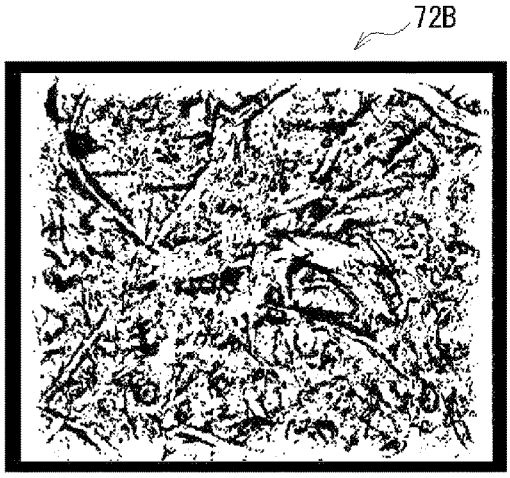
CONTACT SIDE OF ADHESIVE LAYER
FIG. 5
| | STATE | RETENTION TEMPERATURE | REACHED TEMPERATURE | HEATING SPEED | RETENTION TIME | DETECTON TIME |
|---|---|---|---|---|---|---|
| | – | °C | °C | °C/min | min | sec |
| 1 | RETENTION | 20 | 20 | 25 | 10 | 0.4 |
| 2 | HEATING | 20 | 200 | 10 | 5 | 0.4 |
DSC MEASURMENT CONDITIONS FIG. 8A
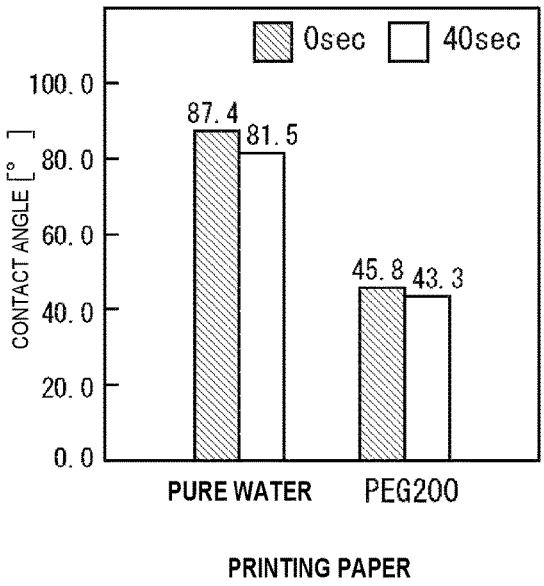
FIG. 8B
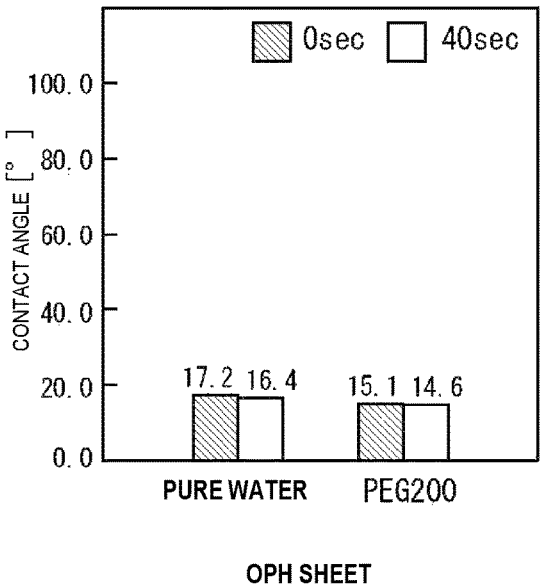
FIG. 9
| PRESS TEMPERATURE [°C] | JUDGE -MENT |
|---|---|
| 135 | × |
| 145 | × |
| 155 | × |
| 165 | × |
| 175 | × |
| 185 | ○ |
| 195 | ○ |

FIG. 13A

| Y | PRINT IMAGE DENSITY [%] | DEPOSITION AMOUNT ON MEDIUM [mg/cm²] | ON T-SHIRT AFTER THERMAL TRANSFER | | | | |
|---|---|---|---|---|---|---|---|
| | | | O. D. | L* | a* | b* | SCALY PATTERN |
| EXAMPLE 1-Y | 100 | 0.43 | 0.73 | 72.04 | -9.08 | 26.37 | ○ |
| | 80 | 0.22 | 0.63 | 71.80 | -7.41 | 19.01 | ○ |
| | 60 | 0.05 | 0.58 | 70.63 | -5.86 | 12.95 | ○ |
| | 40 | 0.01 | 0.48 | 70.64 | -4.02 | 6.89 | ○ |
| COMPARATIVE EXAMPLE 1-Y | 100 | 0.39 | 1.20 | 69.47 | -9.56 | 61.45 | △ |
| | 80 | 0.23 | 0.97 | 70.09 | -8.99 | 47.07 | ○ |
| | 60 | 0.15 | 0.75 | 70.78 | -7.68 | 32.28 | ○ |
| | 40 | 0.08 | 0.58 | 70.23 | -5.29 | 16.72 | ○ |

FIG. 13B

| M | PRINT IMAGE DENSITY [%] | DEPOSITION AMOUNT ON MEDIUM [mg/cm²] | ON T-SHIRT AFTER THERMAL TRANSFER | | | | |
|---|---|---|---|---|---|---|---|
| | | | O. D. | L* | a* | b* | SCALY PATTERN |
| EXAMPLE 1-M | 100 | 0.48 | 0.75 | 55.77 | 28.78 | -7.68 | ○ |
| | 80 | 0.32 | 0.69 | 59.26 | 24.47 | -6.91 | ○ |
| | 60 | 0.10 | 0.57 | 62.83 | 15.65 | -5.67 | ○ |
| | 40 | 0.03 | 0.49 | 65.98 | 9.50 | -4.42 | ○ |
| COMPARATIVE EXAMPLE 1-M | 100 | 0.43 | 1.11 | 45.13 | 42.59 | -10.32 | × |
| | 80 | 0.29 | 0.96 | 49.03 | 38.65 | -10.50 | × |
| | 60 | 0.21 | 0.79 | 53.63 | 28.56 | -9.45 | △ |
| | 40 | 0.14 | 0.61 | 60.12 | 16.04 | -6.41 | ○ |

FIG. 13C

| C | PRINT IMAGE DENSITY [%] | DEPOSITION AMOUNT ON MEDIUM [mg/cm²] | ON T-SHIRT AFTER THERMAL TRANSFER | | | | |
|---|---|---|---|---|---|---|---|
| | | | O. D. | L* | a* | b* | SCALY PATTERN |
| EXAMPLE 1-C | 100 | 0.45 | 0.68 | 61.15 | -10.12 | -15.85 | ○ |
| | 80 | 0.35 | 0.63 | 62.73 | -9.25 | -14.05 | ○ |
| | 60 | 0.26 | 0.58 | 64.04 | -8.16 | -12.63 | ○ |
| | 40 | 0.15 | 0.52 | 66.57 | -6.31 | -9.15 | ○ |
| COMPARATIVE EXAMPLE 1-C | 100 | 0.43 | 1.26 | 46.21 | -23.35 | -33.29 | × |
| | 80 | 0.34 | 1.03 | 51.37 | -20.33 | -28.25 | × |
| | 60 | 0.21 | 0.92 | 52.66 | -18.42 | -27.02 | △ |
| | 40 | 0.15 | 0.77 | 57.10 | -13.93 | -21.15 | ○ |

FIG. 13D

| K | PRINT IMAGE DENSITY [%] | DEPOSITION AMOUNT ON MEDIUM [mg/cm²] | ON T-SHIRT AFTER THERMAL TRANSFER | | | | |
|---|---|---|---|---|---|---|---|
| | | | O. D. | L* | a* | b* | SCALY PATTERN |
| EXAMPLE 1-K | 100 | 0.40 | 0.73 | 50.52 | -0.53 | -5.26 | ○ |
| | 80 | 0.31 | 0.65 | 54.99 | -0.51 | -4.68 | ○ |
| | 60 | 0.22 | 0.61 | 58.17 | -0.43 | -4.36 | ○ |
| | 40 | 0.13 | 0.51 | 62.48 | -0.49 | -3.65 | ○ |
| COMPARATIVE EXAMPLE 1-K | 100 | 0.34 | 1.22 | 29.18 | 1.16 | 2.29 | × |
| | 80 | 0.20 | 1.06 | 35.86 | 1.02 | 1.78 | △ |
| | 60 | 0.13 | 0.89 | 43.07 | 0.75 | 1.47 | ○ |
| | 40 | 0.08 | 0.70 | 52.35 | 0.21 | 0.18 | ○ |

FIG. 14

| | COLOR | PRINTED PORTION | DEPOSITION AMOUNT ON MEDIUM [mg/cm²] | ON T-SHIRT AFTER THERMAL TRANSFER | | | | |
|---|---|---|---|---|---|---|---|---|
| | | | | O. D. | L* | a* | b* | SCALY PATTERN |
| EXAMPLE 1 | R | SILVER 100 [%]+M100 [%]+Y100 [%] | – | 1. 10 | 53. 27 | 25. 58 | 24. 34 | ○ |
| | M | SILVER 100 [%]+M100 [%] | 0. 48 | 0. 75 | 55. 77 | 28. 78 | −7. 68 | ○ |
| | B | SILVER 100 [%]+M100 [%]+C100 [%] | – | 0. 99 | 41. 37 | 16. 76 | −21. 87 | ○ |
| | C | SILVER 100 [%]+C100 [%] | 0. 45 | 0. 68 | 61. 15 | −10. 12 | −15. 85 | ○ |
| | G | SILVER 100 [%]+Y100 [%]+C100 [%] | – | 1. 00 | 57. 43 | −25. 41 | 14. 50 | ○ |
| | Y | SILVER 100 [%]+Y100 [%] | 0. 43 | 0. 73 | 72. 04 | −9. 08 | 26. 37 | ○ |
| COMPARATIVE EXAMPLE 1 | R | SILVER 100 [%]+M40 [%]+Y80 [%] | – | 0. 67 | 59. 30 | 13. 89 | 9. 41 | ○ |
| | M | SILVER 100 [%]+M40 [%] | 0. 14 | 0. 61 | 60. 12 | 16. 04 | −6. 41 | ○ |
| | B | SILVER 100 [%]+M40 [%]+C40 [%] | – | 0. 73 | 50. 29 | 8. 75 | −19. 54 | ○ |
| | C | SILVER 100 [%]+C40 [%] | 0. 15 | 0. 77 | 57. 10 | −13. 93 | −21. 15 | ○ |
| | G | SILVER 100 [%]+Y80 [%]+C40 [%] | – | 0. 60 | 62. 99 | −14. 80 | 3. 29 | ○ |
| | Y | SILVER 100 [%]+Y80 [%] | 0. 08 | 0. 58 | 70. 23 | −5. 29 | 16. 72 | ○ |

MEASUREMENT AND EVALUATION UDER CONDITIONS WHERE NO SCALY PATTERN OCCURS

COLOR GAMUT UNDER CONDITIONS WHERE NO SCALY PATTERN OCCURS

FIRST EMBODIMENT

FIG. 21

| | MAGENTA DEVELOPER PRINT IMAGE DENSITY [%] | LUSTROUS DEVELOPER DEPOSITION AMOUNT ON MEDIUM [mg/cm²] | O.D. VALUE | DENSITY JUDGE | BRIGHTNESS INDEX | | | FI VALUE | METALLICITY JUDGE |
|---|---|---|---|---|---|---|---|---|---|
| | | | | | L15 | L45 | L110 | | |
| EXAMPLE 1 | 100 | 0.65 | 0.71 | ○ | 66.71 | 26.93 | 5.44 | 15.3 | ○ |
| EXAMPLE 2-1 | 100 | 0.12 | 0.89 | ○ | 63.57 | 23.20 | 6.99 | 15.9 | ○ |
| EXAMPLE 2-2 | 100 | 0.14 | 0.83 | ○ | 65.27 | 23.33 | 7.09 | 16.3 | ○ |
| EXAMPLE 2-3 | 100 | 0.19 | 0.85 | ○ | 74.69 | 22.61 | 6.02 | 20.1 | ○ |
| EXAMPLE 2-4 | 100 | 0.23 | 0.77 | ○ | 79.49 | 24.53 | 5.64 | 20.3 | ○ |
| EXAMPLE 2-5 | 100 | 0.28 | 0.79 | ○ | 86.43 | 22.61 | 5.21 | 24.3 | ○ |
| EXAMPLE 2-6 | 100 | 0.34 | 0.71 | ○ | 98.78 | 24.94 | 4.72 | 26.2 | ○ |
| EXAMPLE 2-7 | 100 | 0.36 | 0.75 | ○ | 86.13 | 23.48 | 4.81 | 23.5 | ○ |
| EXAMPLE 2-8 | 100 | 0.42 | 0.68 | × | 107.01 | 24.65 | 4.68 | 29.1 | ○ |
| EXAMPLE 2-9 | 100 | 0.46 | 0.64 | × | 126.07 | 28.45 | 4.03 | 31.3 | ○ |
| EXAMPLE 2-10 | 100 | 0.50 | 0.61 | × | 123.35 | 28.60 | 4.14 | 30.3 | ○ |
| EXAMPLE 2-11 | 100 | 0.52 | 0.61 | × | 127.00 | 28.41 | 3.72 | 31.7 | ○ |
| EXAMPLE 2-12 | 100 | 0.54 | 0.61 | × | 122.40 | 26.69 | 3.86 | 32.0 | ○ |
| EXAMPLE 2-13 | 100 | 0.57 | 0.64 | × | 143.76 | 31.34 | 3.83 | 33.5 | ○ |
| EXAMPLE 2-14 | 100 | 0.61 | 0.60 | × | 118.63 | 28.54 | 3.88 | 29.1 | ○ |

LIGHT EMISSION AND RECEPTION BY VARIABLE ANGLE PHOTOMETER

SECOND EMBODIMENT

ANOTHER EMBODIMENT

IMAGE FORMATION APPARATUS FOR FORMING IMAGE USING METALLIC DEVELOPER AND SUBLIMATION DYEING DEVELOPER AND METHOD OF PRODUCING COLORING MEDIUM USING SAME

CROSS REFERENCE TO RELATED APPLICATIONS

This application claims priority based on 35 USC 119 from prior Japanese Patent Application No. JP2020-013820 filed on Jan. 30, 2020, entitled "IMAGE FORMATION APPARATUS AND METHOD OF PRODUCING COLORING MEDIUM", the entire contents of which are incorporated herein by reference.

BACKGROUND

The disclosure may relate to an image formation apparatus and a method of producing a coloring medium, which may be suitable for application to an electrophotographic printer, for example.

In a related art, an image formation apparatus (may be referred to a printer) is widely spread, which performs printing, by forming a toner image using toner (also called developer) with an image formation unit based on image data supplied from a computer or other device, transferring the toner image to a medium such as paper, and then applying heat and pressure to the toner image to fix the image to the medium. Such an image formation apparatus uses, when general color printing is performed, toner of each color, such as cyan, magenta, yellow, and black, for example (hereinafter referred to as a color toner).

SUMMARY

In recent years, there is a demand to print on various types of media, for example, on a fabric medium such as a T-shirt or the like (hereinafter may be also referred to as a special medium). That is, there is a demand to transfer a developer image formed on a medium to a special medium.

An object of an embodiment of the disclosure may be to propose an image formation apparatus and a method of producing a coloring medium that can improve a quality of an image transferred on a special medium.

An aspect of the disclosure may be an image formation apparatus that may include: a first image formation section that forms a first image of a developer containing a lustrous pigment; a second image formation section that forms a second image of a dyeing developer; and a transfer section that transfers the first image and the second image onto a medium such that the first image and the second image are stacked to each other on the medium.

Another aspect of the disclosure may be an image formation apparatus that may include: a first image formation section including a first photosensitive drum and a first developer container to accommodate therein a first developer containing a metallic pigment and a dyeable resin and configured to form a first developer image using the first developer; a second image formation section including a second photosensitive drum and a second developer container to accommodate therein a second developer containing a sublimation transfer dye and configured to form a second developer image using the second developer; and a transfer section including a transfer roller to be supplied with a bias voltage and configured to transfer the first developer image and the second developer image onto a medium such that the first developer image and the second developer image are stacked to each other on the medium.

Another aspect of the disclosure may be a method of producing a coloring medium, wherein the method may include: forming a first image of a developer containing a lustrous pigment; forming a second image of a dyeing developer; and transferring the first image and the second image onto a medium such that the first image and the second image are stacked to each other on the medium.

According to at least one of the above aspects, the medium on which the first image and the second image stacked to each other can be obtained. When performing heat transfer using the first image and the second image stacked to each other, the first image and the second image are transferred to a second medium or a final medium while the developer of the first image can be dyed by the dyeing developer of the second image, so as to print, on the second medium or the final medium, the second image having metallic color expression due to the lustrous pigment.

As a result, even if a layer thickness of the second image on the medium is not thick, an image quality of the second image on the second medium or the final medium can be maintained with the metallic color expression caused by the first image. Thereby, a high-quality image with the metallic color expression can be printed on the second medium or the final medium.

Therefore, an image formation apparatus and a method of manufacturing a coloring medium that can improve a quality of an image transferred to a special medium can be realized.

BRIEF DESCRIPTION OF DRAWINGS

FIGS. 3A and 3B are diagrams illustrating configurations of an M-sheet and a T-sheet.

FIGS. 4A and 4B are diagrams illustrating conditions of surfaces of an adhesive layer.

FIG. 5 is a table illustrating conditions of differential scanning calorimetry (DSC) measurement.

FIGS. 8A and 8B are diagrams illustrating results of wettability measurements on a printing paper and an OHP sheet.

FIG. 9 is a table illustrating a press temperature during an ironing press in a first transfer process.

FIGS. 13A to 13D are tables illustrating results of measurement and evaluation for the developers of respective colors.

FIG. 14 is a table illustrating results of measurement and evaluation of the developers of the respective colors under conditions in which no scaly pattern has been generated.

FIG. 21 is a table illustrating results of measurement and evaluation of a lustrous developer deposition amount on the medium for each Examples.

DETAILED DESCRIPTION

Figure 1:
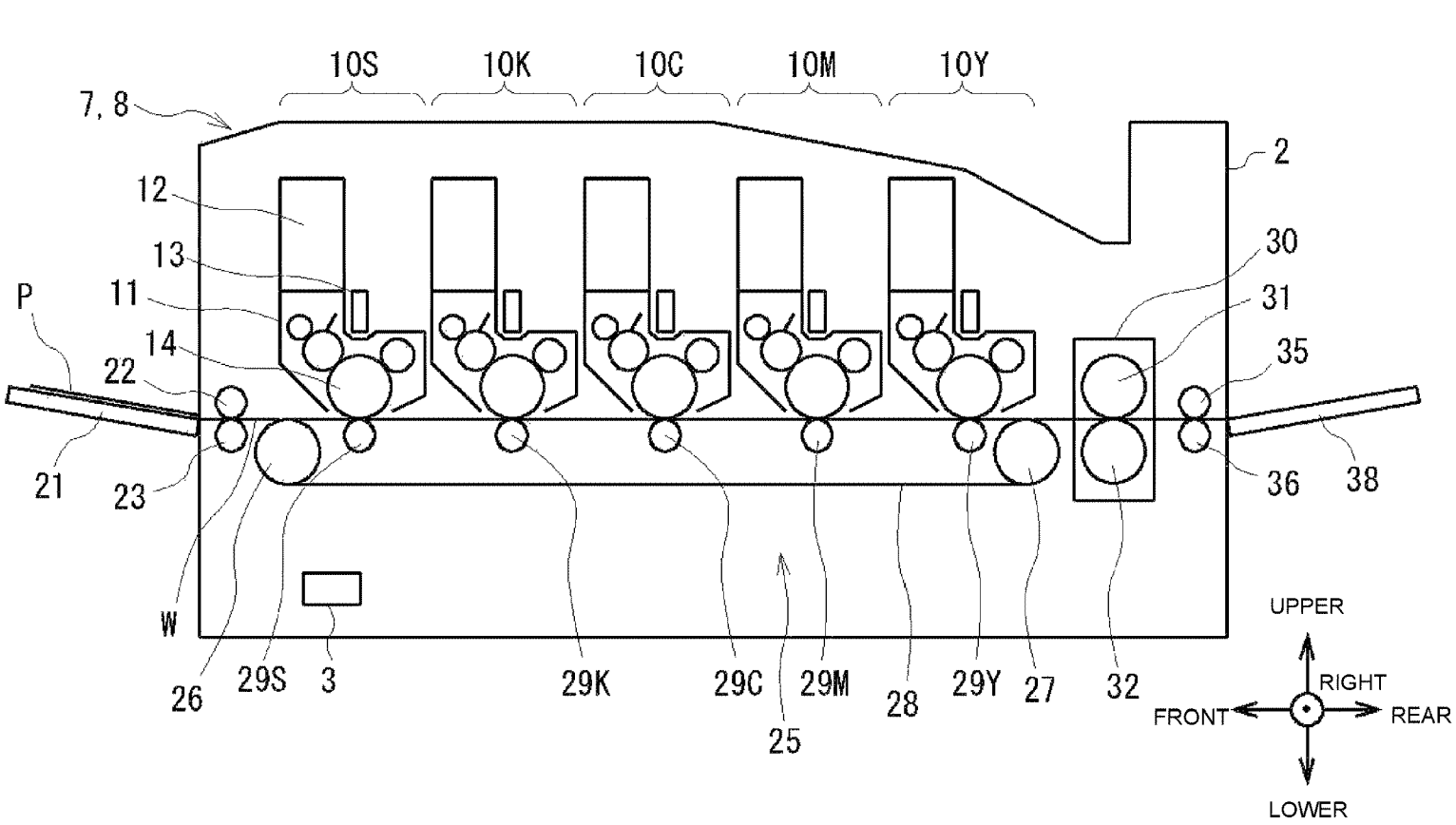
FIG. 1 is a diagram of a right-side view of an image formation apparatus illustrating a configuration of the image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only. Hereinafter, modes for carrying out the invention (hereinafter, referred to as embodiments) are described with reference to the drawings.

1. First Embodiment

[1-1. Configuration of Image Formation Apparatus]

As illustrated in FIG. 1, an image formation apparatus 1 according to a first embodiment is an electrophotographic printer, which is capable of forming (i.e., printing) a color image on paper P as a medium (a first medium or a printing medium). Note that the image formation apparatus 1 is a single function printer (SFP) having a printer function, without having an image scanner function to read a document, a communication function using a telephone line, or the like.

The image formation apparatus 1 has various parts arranged inside a printer housing 2 (an apparatus housing) substantially formed in a box shape. In the following description, the leftmost portion in FIG. 1 is the front of the image formation apparatus 1, and the vertical, horizontal, and front-rear directions are defined as seen facing the front.

A controller 3 controls the overall of the image formation apparatus 1. The controller 3 includes a CPU (Central Processing Unit), ROM (Read Only Memory), RAM (Random Access Memory) and the like, which are not illustrated in the figures, and executes various processes by reading and executing predetermined programs. The controller 3 is connected wirelessly or by wire to an external apparatus such as a computer device (not illustrated). When image data representing an image to be printed and an instruction to print the image date are provided by an external device, the controller 3 performs a printing process of forming a printed image on the surface of the paper P.

Provided at a front side on the top of the printer housing are a display section 7 and an operation section 8. The display section 7 may be formed of a display device, such as a liquid crystal panel, etc. and displays information in letters, images, etc. based on the control of the controller 3. The operation section 8 may be formed of a plurality of operation buttons, such as a directional button, an OK button, and a cancel button. The operation section 8 receives a user's operation and/or instruction and notifies the controller 3 of the operation and/or instruction.

Provided slightly below the center in a printer housing 2 is a conveyance path W extending along a direction generally parallel to the front-rear direction. Various components are arranged along this conveyance path W inside the printer housing 2. Thus, the image formation apparatus 1 forms (i.e., prints) an image on the paper P while conveying the paper P along the conveyance path W.

In particular, the controller 3 controls a positional relationship, on the medium, between a first image formed by an image formation unit 10S as a first image formation section and a second image formed by image formation units 10K, 10C, 10M and 10Y serving as a second image formation section.

Specifically, in the image formation apparatus 1 having a direct transfer system using a transfer belt 28, the controller 3 controls the first image formation section (the image formation unit 10S), the second image formation section (the image formation units 10K, 10C, 10M and 10Y), and a transfer section (a transfer conveyance section 25) to transfer the first image and the second image on the printing medium (M sheet 53) being conveyed by the transfer belt 28 such that the first image and the second image are stacked to each other on the printing medium 53, as described in detail below. The transfer conveyance section 25 may correspond to a transfer section 84 illustrated in FIG. 17 according to an embodiment.

At the upper portion in the printer housing 2, i,e., above the conveyance path W, five image formation units 10S, 10K, 10C, 10M and 10Y are arranged in order from the front side to the rear side along the conveyance path W. The image formation units 10S, 10K, 10C, 10M and 10Y respectively correspond to a special color (S), a black color (K), a cyan color (C), a magenta color (M) and a yellow color (Y), but differ only in color and have the configuration same as or similar to each other.

A textile printing black toner (K), a textile printing cyan toner (C), a textile printing magenta toner (M) and a textile printing yellow toner (Y) are used for forming the second image and have dyeing properties. On the other hand, the special color (S) is a special color, such as white, clear (transparent or colorless), or silver, which is used to form the first image. For convenience of explanation, the image formation units 10K, 10C, 10M, and 10Y serving as the second image formation section that forms the second image and the image formation unit 10S serving as the first image formation section that forms the first image may be referred to as image formation units 10.

Each of the image formation units 10 includes a main body 11 of the image formation unit, a toner cartridge 12, and a print head 13. In the image formation unit main body 11, plural rollers, such as a development roller and the like and a photosensitive drum 14 and the like are incorporated. The plural rollers and the photosensitive drum 14 are all formed in a cylindrical column shape with a center axis extending along the left-right direction and are rotatably supported by the image formation unit main body 11. The photosensitive drum 14 is in contact with the conveyance path W at the lower end of the photosensitive drum 14. Some of the rollers are composed of electrically conductive material to which predetermined high voltages are applied respectively.

The toner cartridge 12 contains a toner as a developer and is mounted to an upper portion of the image formation unit main body 11. The toner cartridge 12 supplies the toner accommodated in the toner cartridge 12 to the image formation unit main body 11. The print head 13 has a plurality of light-emitting elements, such as LEDs (Light Emitting Diodes), arranged along the left-right direction. The print head 13 emits lights based on bitmap data supplied from the controller 3.

When performing the printing process, the image formation unit 10 rotates the plural rollers, the photosensitive drum, and the like in the image formation unit main body 11 while applying the predetermined high voltages to them appropriately, and controls the print head 13 to emit lights appropriately. Thereby, the image formation unit 10 forms a toner image, serving as a developer image, using the toner, serving as the developer, supplied from the toner cartridge 12 on the circumferential surface of the photosensitive drum 14. Then, the developer image formed on the photosensitive drum 14 is moved toward the bottom portion of the photosensitive drum 14, i.e., near the conveyance path W, along with the rotation of the photosensitive drum 14.

A paper feed tray 21 is provided at the front portion in the printer housing 2. The paper feed tray 21 is formed in a flat plate-like shape, the top surface of which is generally flat. The top surface of the paper feed tray 21 is inclined such that the rear side thereof extends slightly downward with respect to the horizontal direction, and the rear end thereof is positioned at approximately the same height as that of the conveyance path W. On the paper feed tray 21, the sheets of the paper P are placed with the printing surface thereof (the surface to be printed) facing upward. The sheets of the paper P are stacked on the paper feed tray 21.

At the rear side of the paper feed tray 21, resist rollers 22 and 23 are located on the upper and lower sides of the conveyance path W, respectively. The resist rollers 22 and 23 are formed in cylindrical column shapes with axes along the left-right direction. Circumferential surfaces of the resist rollers 22 and 23 are in contact with each other at the conveyance path W. The resist rollers 22 and 23 are rotated according to a driving force supplied from a motor (not illustrated), so as to separate the paper P placed on the paper feed tray 21 one by one and feed the paper P in the rear direction.

The rotation of the resist rollers 22 and 23 is controlled appropriately to exert a frictional force on the paper P, to correct the so-called skew of the paper P with respect to the travel direction of the paper P, that is, to align the leading and trailing ends of the paper P along the left-right direction, and then feed the paper in the rear direction.

At the rear side of the resist rollers 22 and 23, the transfer conveyance section 25 is provided on the lower side of the conveyance path W, i.e., the lower side of the five image formation units 10. The transfer conveyance section 25 includes a front conveyance roller 26, a rear conveyance roller 27, a transfer belt 28 and five transfer rollers 29 (29S, 29K, 29C, 29M and 29Y). For convenience of explanation, the transfer rollers 29S, 29K, 29C, 29M, and 29Y may be referred to as transfer rollers 29.

The front conveyance roller 26 is formed in a cylindrical column shape with a center axis extending along the left-right direction. The front conveyance roller 26 is disposed at the front lower side of the image formation unit 10S with a portion of the front conveyer roller 26 near the upper end of the front conveyer roller 26 being located in contact with or very close to the conveyance path W. Like the front conveyance roller 26, the rear conveyance roller 27 is formed in a cylindrical column shape with a center axis extending along the left-right direction, and is disposed at the rear lower side of the image formation unit 10Y with a portion of the rear conveyance roller 27 near the upper end of the rear conveyance roller 27 being located in contact with or very close to the conveyance path W.

The transfer belt 28 is an endless belt formed of a flexible material and is sufficiently wide in the left-right direction. The transfer belt 28 is wound and strung around the front conveyance roller 26 and the rear conveyance roller 27. For this reason, along with the rotation of the transfer belt 28, the upper line of the transfer belt 28, stretched between the front and rear conveyance rollers 26 and 27, runs along the conveyance path W while being in contact with the lower end of the photosensitive drum 14 of each of the image formation units 10.

Each of the transfer rollers 29 (29S, 29K, 29C, 29M and 29Y) is formed in a cylindrical column shape with a center axis extending along the left-right direction, like the front and rear conveyance rollers 26 and 27 and the like. The transfer rollers 29S, 29K, 29C, 29M, and 29Y are provided between the front conveyance roller 26 and the rear conveyance roller 27 and respectively located at positions directly below the image formation units 10S, 10K, 10C, 10M, and 10Y. Each of the transfer rollers 29 is also biased upwardly such that the upper end portions thereof are in contact with the transfer belt 28. In other words, the transfer belt 28 is sandwiched between each transfer roller 29 and the photosensitive drum 14 of the corresponding image formation unit 10, at the conveyance path W. Predetermined high voltages are supplied to the transfer rollers 29, like the plural rollers of the image formation unit 10.

The transfer conveyance section 25 rotates the front conveyance roller 26, the rear conveyance roller 27, and the transfer rollers 29 appropriately, causing the transfer belt 28 to rotate around the front conveyance roller 26 and the rear conveyance roller 27, and to run the upper line of the transfer belt 28 along the conveyance path W in the rear direction (hereinafter may be referred to as a conveyance direction). if the paper P is supplied from the resist rollers 22 and 23 provided in front of the transfer conveyance section 25 when the transfer belt 28 is rotated, the transfer conveyance section 25 conveys the paper P along the conveyance path W in the rear direction while sandwiching the paper P along the transfer belt 28 between the photosensitive drums 14 of the image formation units 10 and the corresponding transfer rollers 29. At this time, if the image formation units 10 form the developer images, the developer images are transferred from the circumferential surfaces of the photosensitive drums 14 of the image formation units 10 to the upper surface of the paper P (i.e., the printing surface).

In the image formation apparatus 1, while the paper P is conveyed in the rear direction along the conveyance path W, the developer images of respective colors (i.e., lustrous developer image, textile printing black developer image, textile printing cyan developer image, textile printing magenta developer image, textile printing magenta developer image, and textile printing yellow developer image) are sequentially transferred from the image formation units 10S, 10K, 10C, 10M and 10Y to the paper P. Therefore, when the developer images are transferred to the same position by the respective image formation units 10, the silver (S), textile printing black (K), textile printing cyan (C), textile printing magenta (M) and textile printing yellow (Y) developers are sequentially overlaid on the printing surface of the paper P. For convenience of explanation, hereinafter, the textile printing black developer image, the textile printing cyan developer image, the textile printing magenta developer image, and the textile printing yellow developer image may be referred to as textile printing color developer images.

A fixation unit 30 or a fixation device 30 is located at the rear side of the image formation unit 10Y and the transfer conveyance section 25. The fixation unit 30 includes a heating roller 31 and a pressure roller 32 disposed opposite to each other across the conveyance path W. The heating roller 31 is formed in a cylindrical tubular shape with a center axis extending along the left-right direction, and a heater is provided inside thereof. The pressure roller 32 is formed in a cylindrical tubular shape same as or similar to the heating roller 31 and presses the upper surface thereof against the lower surface of the heating roller 31 with a predetermined pressure force.

According to the control of the controller 3, the fixation unit 30 heats the heating roller 31 and rotates the heating roller 31 and the pressure roller 32 in the predetermined directions, respectively. With this, the fixation unit 30 applies heat and pressure to the paper P received from the transfer conveyance section 25, i.e., the paper P on which the developer images of respective colors are superimposed, to fix the developer images, and then conveys the paper P having the developer images thereon in the rear direction.

Paper discharge rollers 35 and 36 are located slightly above the rear side of the fixation unit 30. The paper discharge rollers 35 and 36 are all formed in a cylindrical column shape with a center axis extending along the left-right direction, and circumferential surfaces of the paper discharge rollers 35 and 36 are in contact with each other along the conveyance path W. The paper discharge rollers 35 and 36 rotate appropriately according to the control of the controller 3 to convey the paper P, conveyed from the fixation unit 30, toward the upper rear side of thereof and discharge the paper P onto a discharged paper tray 38 provided at the rear side of the printer housing 2.

In this way, in the image formation apparatus 1, the image formation units 10 form the developer images using the developers in the image formation units 10, the transfer conveyance section 25 transfers the developer images to the paper P being conveyed by the transfer belt 28, and the fixation unit 30 then fix the developer images to the paper P, so as to print the image on the paper P (i.e., form the image).

[1-2. Compositions of Developers]

Next, the compositions of the developers are described. Each developer contains a toner mother particle containing at least a binding resin (also called a binder resin) and external additives such as an inorganic or organic fine powder added to the binder resin. A release agent, a coloring agent (colorant), and/or the like are added to the binder resin. In addition, other additives such as a charge control agent, a conductivity modifier, a flow-improving agent and/or a cleaning improvement agent may be added or a mixture of plural thereof may be added to the binder resin. In an embodiment, a crystalline polyester resin having a crystalline structure in addition to a plurality of amorphous polyester resins are used as the binding resin. Other additives such as a fluorescent whitening agent, a charge control agent, a conductivity regulator, a flow-improving agent, and/or a cleaning improvement agent may be appropriately added to the bonding resin in addition to the release agent, the coloring agent, and/or the like.

Each of the lustrous developer and the textile printing developer described here is, for example, a negatively charged developer of a single component development type. In other words, the toner may have a negatively charged polarity, for example. The single component development type developer provides the toner itself with an appropriate amount of electric charge and thereby applies the electric charge to the toner itself without using a carrier (e.g., magnetic particles) that imparts charge to the toner. A method of manufacturing the toner is not particularly limited. Specifically, the toner may be manufactured, for example, by a pulverization method, a polymerization method, or any other method. Of course, two or more of the above-mentioned manufacturing methods may be used in combination. The polymerization method includes, for example, an emulsion polymerization agglomeration method, a dissolution-suspension method, and the like.

In an embodiment, polyester is used as a main component of the base resin of the lustrous developer and also polyester is used as a main component of the base resin of the textile printing color developer.

[1-2-1. Composition of Lustrous Developer]

The lustrous developer (or metallic lustrous developer), serving as a development agent to be dyed, has the property of being dyeable by the textile printing developer (textile printing dye as a coloring agent) as a dyeing development agent, that is, the lustrous developer includes a dyeable polymer compound. Here, the development agent includes ink. The textile development agent includes textile printing ink. In other words, the lustrous developer functions as a receptor that accepts, when thermal energy is supplied to the textile printing developer, a disperse dye (textile printing dye) which is transferred from the textile printing developer by using the thermal energy. The lustrous developer accepts the textile printing developer, and thus is dyed by the textile printing developer, so as to enable to express a metallic color.

The lustrous developer includes, for example, one or two or more of polymeric compounds. These polymeric compounds are polymeric compounds (dyeable resins) that have the property of being dyeable by the textile printing developer. Specifically, the polymer compounds are, for example, a polyester resin, a styrene-acrylic resin, an epoxy resin, a styrene-butadiene resin, and/or the like.

As used herein, the term "polyester-based resin" collectively refers to polyesters and derivatives of the polyesters. In other words, the term "-based" in the "polyester-based resin" means that it includes not only polyester but also derivatives. The definition of the term "-based" is similarly applicable to other terms such as the "styrene-acrylic-based resin", the "epoxy-based resin", and the "styrene-butadiene-based resin".

It may be preferable that the polymer compound includes the polyester-based resin among them. Firstly, this is because the lustrous developer containing the polyester-based resin become more easily to be dyed by the textile printing developer, as a dyeable developer to be dyed by the textile printing developer. Secondly, this is because the polyester-based resins have high physical strength even at a relatively small molecular weight, and thus the lustrous developer containing the polyester-based resin has excellent durability. Thirdly, this is because even if the lustrous developer has inherently low charging characteristics, the lustrous developer containing the polyester-based resin become more easier to be fixed on the medium. Note that the lustrous developer does not need to contain polyester more than 50[%] of the total lustrous developer as a main component of the lustrous developer, and the lustrous developer is dyed if the lustrous developer contains some polyester (e.g., more than 1 [%] of the total).

The polyester-based resin is not particularly limited in its crystalline state. Therefore, the polyester-based resin may be crystalline polyester, amorphous polyester, or both. It also makes it easier for the lustrous developer to be fixed onto the medium and improves the durability of the lustrous developer. The polyester-based resin is, for example, a reaction (condensation polymer) of one or more alcohols with one or more carboxylic acids.

Although the type of the alcohol is not particularly limited, it may be preferable that the alcohol be of a bivalent or higher value and its derivatives. These divalent or higher alcohols include, for example, ethylene glycol, diethylene glycol, triethylene glycol, polyethylene glycol, propylene glycol, butanediol, pentanediol, hexanediol, cyclohexan dimethanol, xylene glycol, dipropylene glycol, polypropylene glycol, bisphenol A, hydrogenated bisphenol A, bisphenol an ethylene oxide, bisphenol a propylene oxide, sorbitol, glycerin, and the like.

Although the type of the carboxylic acid is not particularly limited, it may be preferable that the carboxylic acid is a divalent or more carboxylic acid or its derivatives, among others. These divalent or higher carboxylic acids include, for example, maleic acid, fumaric acid, phthalic acid, isophthalic acid, terephthalic acid, succinic acid, adipic acid, trimellitic acid, pyromellitic acid, cyclopentanedic acid, succinic anhydride, trimellitic anhydride, maleic anhydride, dodecenyl succinic anhydride, and the like.

Note that the color of the lustrous developer is not particularly limited as long as it contains a metallic pigment, however it may be preferable that the lustrous developer is a silver-colored developer containing aluminum or the like. In this case, the metallic luster color of the lustrous developer image (the dyeable developer image) is silver, so that the metallic color can be expressed without interfering with the hue of the lustrous developer image.

[1-2-2. Composition of Textile Printing Developer]

In an embodiment, the image formation units 10K, 10C, 10M, and 10Y, serving as the second image formation section, that form the second image using the textile printing developers (textile printing dyes: textile printing toners) having sublimation transferability, such as a textile printing black developer, a textile printing cyan developer, a textile printing magenta developer, and a textile printing yellow developer, respectively. Each of the textile printing developers includes a textile printing dye, a disperse dye, or a textile printing pigment (here, a textile printing dye). Note that the textile printing color developer may be referred to as a sublimation developer or a sublimation transfer developer.

The textile printing magenta developer includes a textile printing magenta dye, a binding agent, and a charge control agent. The textile printing magenta dye is, for example, C.I. Reactive Red 3, C.I. Disperse Red 60, C.I. Disperse Red 92, or the like. The binding agent is, for example, a polyester-based resin, a styrene-acrylic-based resin, an epoxy-based resin, a styrene-butadiene-based resin, or the like. The charge control agent is, for example, an azo-based complex, a salicylic acid-based complex, a calixarene-based complex, or the like. A release agent may also be included in addition to the dye, binding agent and charge control agent described above.

The textile printing yellow developer includes a textile printing yellow dye, a binding agent, and a charge control agent. The textile printing yellow dye is, for example, C.I. Reactive Yellow 54, C.I. Disperse Yellow 54, C.I. Disperse Yellow 82, or the like. The binding agent and charge control agent in the textile printing yellow developer are the same as or similar to the textile printing magenta developer.

The textile printing black developer includes a textile printing black dye, a binding agent, and a charge control agent. The textile printing black dye is, for example, C. L Reactive Black 5 or the like. It is to be noted that the textile printing black dye may be a mixture of the textile printing yellow dye, the textile printing magenta dye, and the textile printing cyan dye. The binding agent and charge control agent in the textile printing black developer are the same or similar to the textile printing magenta developer.

The textile printing cyan developer includes a textile printing cyan dye, a binding agent, and a charge control agent. The textile printing cyan dye is, for example, C.I. Disperse Blue 60, C.I. Disperse Blue 359, C.I. Disperse Blue 360, C.I. Solvent Blue 63, I. Disperse Blue 72, Cibacron Turquoise Blue FGF-P, or the like. The binding agent and charge control agent in the textile printing cyan developer are the same as or similar to the textile printing magenta developer.

The content amount of the textile printing dye (the textile printing magenta dye, textile printing yellow dye, textile printing black dye or textile printing cyan dye) as a disperse dye (colorant) is not particularly limited, but, may be, for example, 2 to 25 (parts by weight), preferably 2 to 15 (parts by weight) added to 100 (parts by weight) of the binding agent.

As the charge control agent, known ones can be used. In the case of a negative charge developer, the charge control agent is, for example, an azo-complex charge-control agent, a salicylic acid-complex charge-control agent, a calixarene charge-control agent, or the like. The content amount of the charge control agent is 0.05 to 15 (parts by weight), preferably 0.1 to 10 (parts by weight), added to 100 (parts by weight) of the binder resin. The external additives which are subsequently added to the mother particle are added to improve environmental stability, electrification stability, development properties, flowability, and storage stability, and can be a known one. The content amount of the external additives is 0.01 to 10 (parts by weight), preferably 0.05 to 8 (parts by weight), to 100 (parts by weight) of the binder resin. In the adding process, the external additives are added at a fixed ratio and adhered to the toner resin. In addition, 0.5 to 3.0 (parts by weight) of silica larger than 50 [nm] as external additives may be added to adjust the flowability and the like of the toner.

[1-3. Configurations of Special Medium Printing System and Each Medium]

Figures 2A, 2B, 2C:
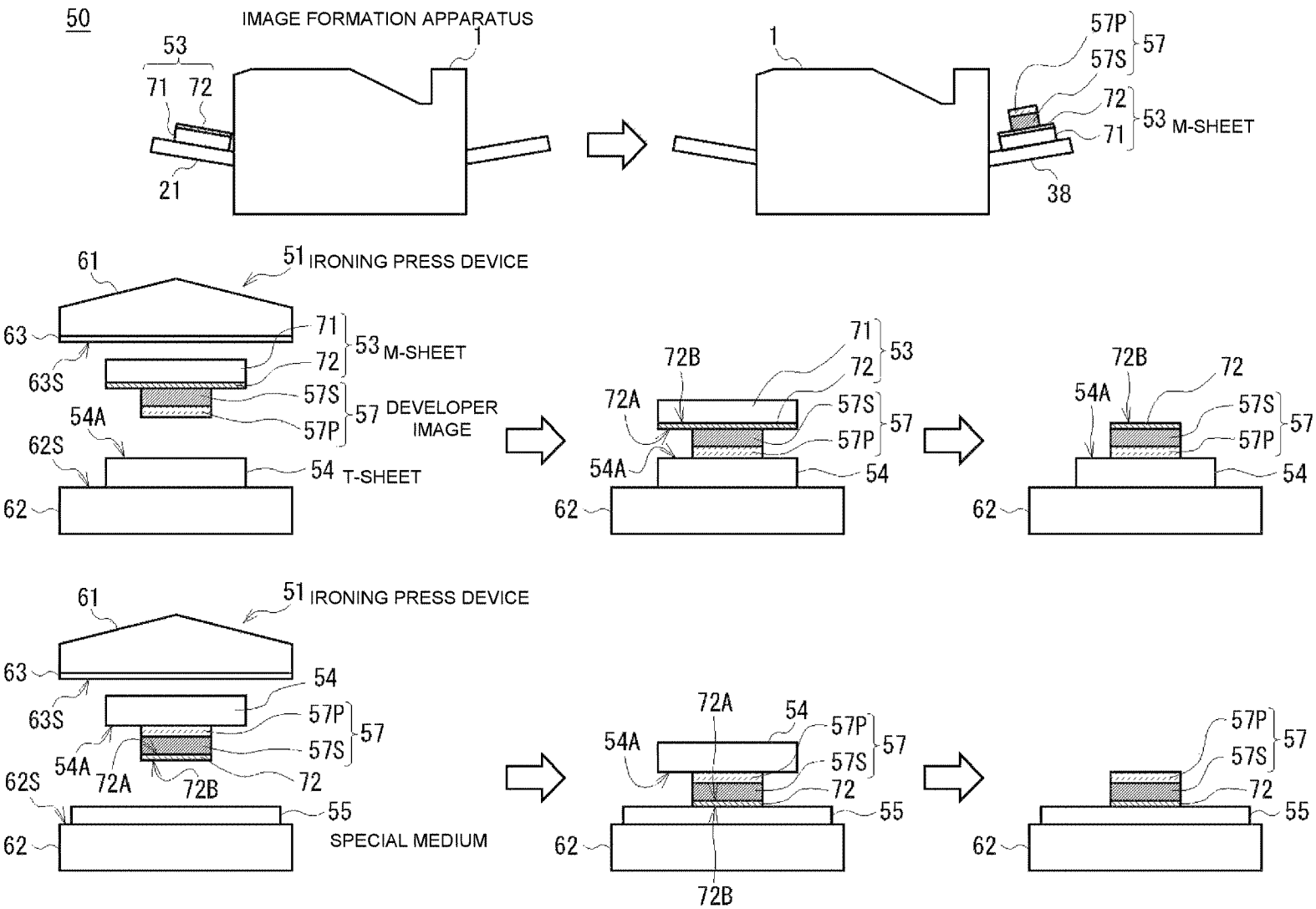
FIGS. 2A to 2C are diagrams illustrating printing of an image by a special medium printing system according to a first embodiment.

Next, forming an image, that is, printing an image, by a special medium printing system 50 according to a first embodiment is described. As illustrated in FIGS. 2A, 2B and 2C, the special medium printing system 50 includes the above-described image formation apparatus 1 and an ironing press device 51, wherein a M sheet 53, a T sheet 54 and a special medium 55 are used as media.

[1-3-1. Configuration of Ironing Press Device]

HTP 234 PS1 manufactured by TheMagicTouch can be used as the ironing press device 51 serving as a heating and pressurizing device, for example. The ironing press device 51 includes an upper iron part 61 (upper ironing block 61) provided at the upper side and a lower iron part 62 (lower ironing block) provided at the lower side, as illustrated in FIGS. 2B and 2C.

A heat source 63 is built in a lower portion of the upper iron part 61. The heat source 63 has a flat heating surface 63S, which is the lower surface thereof, and can generate heat. In the ironing press device 51, the degree of heat generation at the heat source 63 can be adjusted to make the heating surface 63S the desired temperature. The lower iron part 62 includes a flat upper surface 62S thereof, to which the medium is placed.

The ironing press device 51 further includes a displacement mechanism (not illustrated) and thus can move the upper iron part 61 in the vertical direction with respect to the lower iron part 62 in the state where the heating surface 63S of the heat source 63, which is the lower surface of the upper iron part 61, is opposed to the upper surface 62S of the lower iron part 62. This allows the ironing press device 51 to pull the upper iron part 61 upwardly away from the lower iron part 62 and to press the upper iron part 61 onto the lower iron part 62. The ironing press device 51 can set the pressure for pressing the upper iron part 61 onto the lower iron part 62 to a desired value.

[1-3-2. Configurations of Media]

As the M sheet 53, serving as a medium used for ironing transfer (may be referred to as an iron-on transfer medium or transfer medium), an M sheet of WoW 7.8 Textile Transfer for dark-colored fabrics manufactured by TheMagicTouch is used. The M sheet 53 includes a backing sheet 71 (or mount) and an adhesive layer 72 laminated to the backing sheet 71, as illustrated in a schematic side view of FIG. 3A. The M sheet 53 has an overall thickness of about 120.5 [μm], the thickness of the backing sheet 71 is about 80.5 [μm], and the thickness of the adhesive layer 72 is about 40.0 [μm].

The backing sheet 71, as a base layer or a base material of the M sheet 53, is made of paper which is relatively thick and sufficiently rigid. A surface 71A (the upper surface in the figure) of the backing sheet 71 on which the adhesive layer 72 is laminated (hereinafter may be referred to as a release side 71A or a peeling side 71A), is coated with an oil and fat material (hereinafter may be referred to as a release agent) which enhances the release properties. In other words, the backing sheet 71 can be easily peeled off the adhesive layer or material, as is the case with common label paper mounts.

The adhesive layer 72 is composed of a material having adhesive properties. The adhesive layer 72 includes a contact side 72B (a contact surface 72B), which is a lower surface of the adhesive layer 72 in FIG. 3A, in contact with the release side 71A (the release surface 71A) of the backing sheet 71. The adhesive layer 72 also includes a developer transfer side 72A (a developer transfer surface 72A), which is an upper surface of the adhesive layer 72 in FIG. 3A, to which the developer image is to be transferred (described in detail below). For convenience of explanation, the developer transfer side 72A of the adhesive layer 72 may be referred to as a transfer surface or a transfer side of the M sheet 53. The contact side 72B of the adhesive layer 72 may be referred to as a backing sheet contact side or surface.

Here, the developer transfer side 72A and the contact side 72B of the adhesive layer 72 are observed by optical microscopy, respectively, and the images thereof are captured as illustrated in FIGS. 4A and 4B. Note that for the convenience of drawing, FIGS. 4A and 4B illustrate monochrome images, which are obtained by binarization and other processes on captured color images of the developer transfer side 72A and the contact side 72B. These images show that the developer transfer side 72A of the adhesive layer 72 is relatively smooth, whereas the contact side 72B of the adhesive layer 72 is relatively rough, i.e., the surface roughness of the contact side 72B is greater than that of the developer transfer side 72A.

Figure 6:
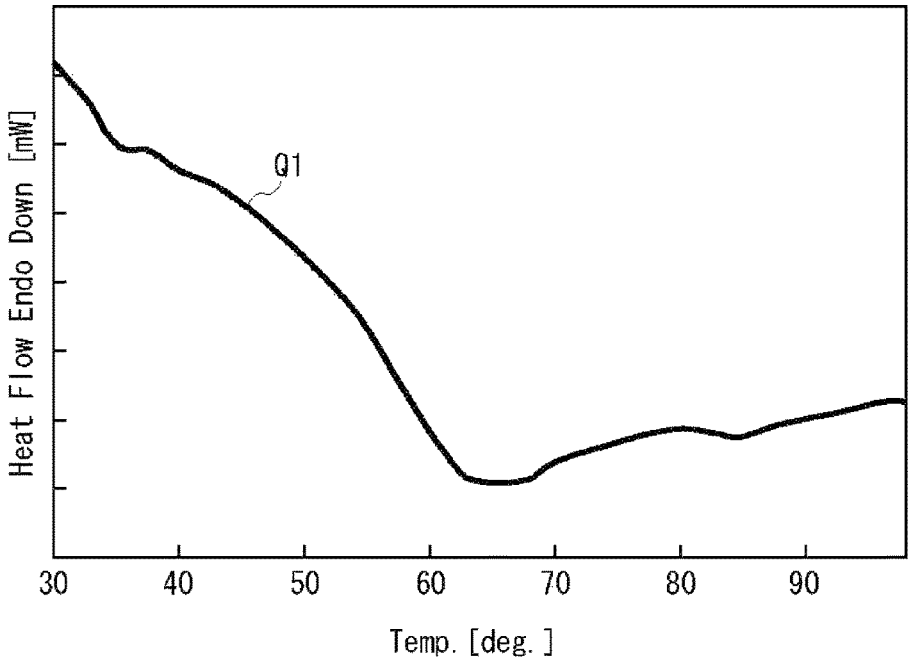
FIG. 6 is a diagram illustrating results of the DSC measurement on the adhesive layer of the M sheet.

For the adhesive layer 72, the differential scanning calorimetry (DSC) thermal characteristics are measured using the thermal analysis system DSC 6220 manufactured by Seiko Instruments Inc. according to the measurement conditions illustrated in FIG. 5. The characteristic curve Q1 illustrated in FIG. 6 is obtained as the results of the measurement. This characteristic curve Q1 has an endothermic peak around 65[° C.]. This reveals that the adhesive layer 72 is a material that changes its molecular structure upon being heated.

Figure 7A:
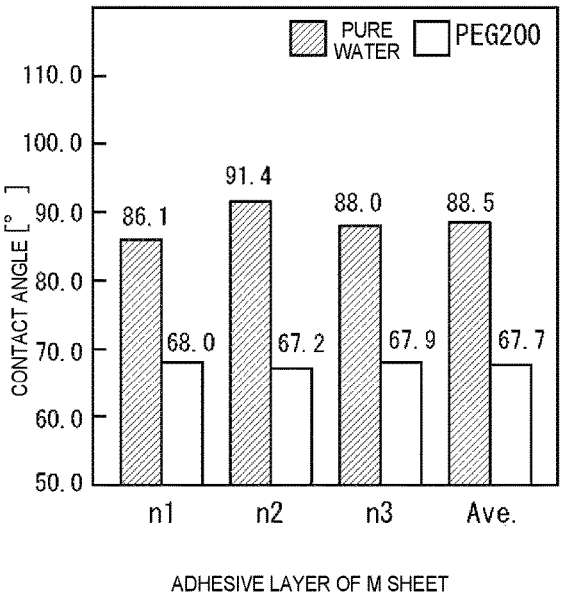
FIGS. 7A and 7B are diagrams illustrating results of wettability measurements on the M sheet and the T sheet.

Furthermore, the wettability of the adhesive layer 72 is measured using three test specimens (n1, n2, and n3). The measurement results reveal that, as illustrated in FIG. 7A, the contact angle of pure water on the adhesive layer 72 is 86.1 to 91.4[°] and the contact angle of polyethylene glycol 200 (hereinafter referred to as PEG 200) on the adhesive layer 72 is 67.2 to 68.0[°]. From this, it is presumed that the adhesive layer 72 is a lipophilic substance.

Figure 7B:
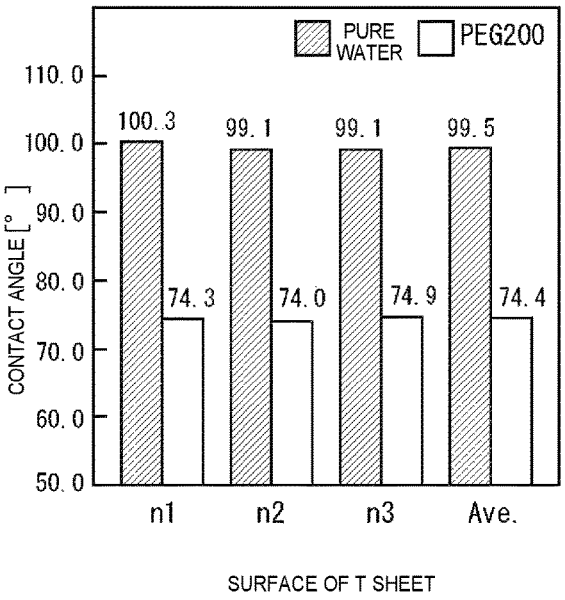

The T sheet 54 (FIGS. 2B and 2C), serving as an intermediate transfer medium, is, for example, T sheet of WoW 7.8 Textile Transfer for dark-colored fabrics manufactured by TheMagicTouch. The T sheet is composed of a generally uniform material, as illustrated in a schematic side view of FIG. 3B. The wettability of a surface 54A (front surface) of the T sheet 54 is measured using three test specimens (n1, n2, and n3). The measurement results reveal that the contact angle of the pure water on the surface 54A of the T sheet 54 is 99.1 to 101.3 degrees [°] and the contact angle of the PEG 200 on the surface 54A of the T sheet 54 is 74.0 to 74.9 degrees [°], as illustrated in FIG. 7B. In other words, the surface 54A (front surface) of the T sheet 54 is less hydrophilic and lipophilic than the adhesive layer 72 of the M sheet 53. From this, it is presumed that a release layer may be formed on the surface 54A of the T sheet 54 by coating the surface 54A of the T sheet 54 with a release agent.

The wettability of each of a general printing paper sheet PS and an over head projector (OHP) sheet OS, which is a transparent sheet made of resin, is also measured in the same way using the purified water and the PEG200, and the measurement results thereof are obtained as illustrated in FIGS. 8A and 8B. Here, Excellent White A4 paper made by OKI Data Corporation is used as the printing paper sheet PS, and OHP film CG3500 (A4 size) made by 3M Corporation is used as the OHP sheet OS. The measurements of the wettability are made at 0 [sec] and 40 [sec], respectively.

The measurement results reveal that the hydrophilic properties of the T sheet 54 are generally comparable to those of the general printing paper sheet PS, while the lipophilic properties of the T sheet 54 are much lower than those of the general printing paper sheet PS. The measurement results also reveal that the hydrophilic properties and the lipophilic properties of the T sheet 54 are both much lower than those of the OHP paper sheet OS.

The special medium 55 (FIG. 2C) is a fabric, such as a T-shirt or the like, which has a greater thickness (i.e., thicker), rougher surface, and much less rigidity than the general printing paper on which an image is generally printed. This may make it extremely difficult for the special medium 55 to be conveyed along the conveyance path W in the image formation apparatus 1, making it virtually impossible for the developer image to be directly transferred to the special medium 55 by the image formation apparatus 1.

[1-3-3. Printing Processes]

Next, a detailed procedure of printing processes in the special medium printing system 50 is described with reference to FIGS. 2A to 2C. In the special medium printing system 50, an image formation process to form an image, a first transfer process to perform a primary transfer process, and a second transfer process to perform a secondary transfer process are generally performed.

First, as illustrated in FIG. 2A, the image formation process of the special medium printing system 50 is performed, in which the image formation apparatus 1 forms the developer image 57 and then transfers the developer image to the M sheet 53 serving as the paper P, that is, the image formation apparatus performs a printing process on the M sheet 53. The developer image 57 includes a lustrous developer layer 57S and a textile printing developer layer 57P. At this time, the image formation apparatus 1 performs the printing process in the state where the M sheet 53 is set on the paper feed tray 21 with the transfer surface of the M sheet 53 (i.e., the surface on which the adhesive layer 72 is laminated) facing upward.

This causes the developer image 57 to be transferred to the developer transfer side 72A of the adhesive layer 72 of the M sheet 53, and thus the developer image 57 is bonded to the adhesive layer 72 of the M sheet 53. In other words, on the transfer surface side of the M sheet 53, the layer of the developer image 57 is overlaid on the adhesive layer 72. In this image formation process (FIG. 2A), the lustrous developer layer 57S of the developer image 57 is formed on the adhesive layer 72 of the M sheet 53, and the textile printing developer layer 57P of the developer image 57 is stacked on the lustrous developer layer 57S.

Next, as illustrated in FIG. 2B, the first transfer process of the special medium printing system 50 is performed, in which the developer image 57 is transferred from the M sheet 53 to the T sheet 54 by the ironing press device 51. Specifically, in the ironing press device 51, the T sheet 54 is placed on the upper surface 62S of the lower iron part 62, and the M sheet 53 is overlaid on the T sheet 54 in such a manner that the transfer surface of the M sheet 53 (i.e., the surface of the M sheet 53 that has the developer image 57 transferred thereon) faces downward to the surface 54A (upper surface 54A) of the T sheet 54.

In this state, the ironing press device 51 starts the ironing press process by pressing the upper iron part 61 against the lower iron part 62 while the upper iron part 61 is heated to a predetermined temperature. After a predetermined time is elapsed, the upper iron part 61 is moved away from the lower iron part 62 to complete the ironing press process. This causes the developer image 57 to be bonded with a relatively strong force to the surface 54A of the T sheet 54.

Thereafter, in the ironing press device 51, the M sheet 53, which is placed on the uppermost side on the lower iron part 62, is pulled (peeled) off the T sheet 54. Note that before the M sheet 53 is pulled off the T sheet 54, the developer image 57 is bonded to the surface 54A of the T sheet 54 on the lower side of the developer image 57 and is bonded to the developer transfer side 72A of the adhesive layer 72 of the M sheet 53 on the upper side of the developer image 57. The force with which the lower surface of the developer image 57 is bonded to the surface 54A of the T sheet 54 and the force with which the upper surface of the developer image 57 is bonded to the developer transfer side 72A of the adhesive layer 72 are greater than the force with which the contact side 72B of the adhesive layer 72 is bonded to the backing sheet 71.

For this reason, after the M sheet 53 is pulled off the T sheet 54, the developer image 57 and the adhesive layer 72 remain on the T sheet 54 in the area where the transferred developer image 57 is provided. That is, the developer image 57 and the adhesive layer 72 are transferred to the surface 54A of the T sheet 54.

In this first transfer process (FIG. 2B), the M sheet 53 and the T sheet 54 are heated and pressed, in the state where the textile printing developer layer 57P of the developer image 57 is in contact with the surface 54A of the T sheet 54. Furthermore, in the first transfer process, after the peeling of the M sheet 53 off the T sheet 54, the textile printing developer layer 57P of the developer image 57, the lustrous developer layer 57S of the developer image 57, and the adhesive layer 72 are sequentially stacked from below in that order on the surface 54A of the T sheet 54.

Next, as illustrated in FIG. 2C, the second transfer process of the special medium printing system 50 is performed, in which the developer image 57 is transferred from the T sheet 54 to the special medium 55 by the ironing press device 51. Specifically, in the ironing press device 51, the special medium 55 is placed on the upper surface 62S of the lower iron part 62, and the T sheet 54 is overlaid on the special medium 55 in such a manner that the surface 54A (front surface) of the T sheet 54 (i.e., the surface of the T sheet 54 that has the developer image 57 and the adhesive layer 72 transferred thereon) faces downward to the special medium 55.

In this state, the ironing press device 51 presses the upper iron part 61 against the lower iron part 62 while the upper iron part 61 is heated to a predetermined temperature, and after a predetermined time is elapsed, the upper iron part 61 is pulled away from the lower iron part 62. This causes the lower contact side 72B of the adhesive layer 72 to be bonded to the surface of the special medium 55 with a relatively strong force. The upper developer transfer side 72A of the adhesive layer 72 continues to be bonded with the developer image 57 with a relatively strong force.

Thereafter, in the ironing press device 51, the T sheet 54, which is placed on the uppermost side on the lower iron part 62, is pulled (or peeled) off from the special medium 55. Note that the force with which the contact side 72B of the adhesive layer 72 is bonded to the special medium 55 and the force with which the developer transfer side 72A of the adhesive layer 72 is bonded to the developer image 57 are greater than the force with which the developer image 57 is bonded to the surface 54A of the T sheet 54.

For this reason, after the T sheet 54 is pulled off the special medium 55, the developer image 57 and the adhesive layer 72 remain on the special medium 55. In other words, after the T sheet 54 is pulled off the special medium 55, the special medium 55 has the adhesive layer 72 and the developer image 57 transferred thereon.

In this second transfer process (FIG. 2C), the T sheet 54 and the special medium 55 are heated and pressed in the state where the adhesive layer 72 is in contact with the surface of the special medium 55, and the adhesive layer 72, the lustrous developer layer 57S of the developer image 57, the textile printing developer layer 57P of the developer image 57, and T sheet 54 are sequentially stacked from below in that order on the special medium 55. Subsequently, in the second transfer process, after the separation of the T sheet 54 from the special medium 55, the adhesive layer 72, the lustrous developer layer 57S, and the textile printing developer layer 57P of the developer image 57 are sequentially stacked from below in that order on the surface of the special medium 55. With this, the printing processes of the special medium printing system 50 are completed.

Therefore, in the special medium printing system 50, by forming the developer image 57 and transferring the developer image 57 twice using the M sheet 53 and the T sheet 54, the developer image 57 can be finally transferred and bonded to the special medium 55, i.e., the image can be finally printed on the special medium 55.

[1-4. Print Quality Evaluation]

Next, the print quality on the special medium 55 printed by the printing processes of the special medium printing system 50 under various conditions is evaluated. Specifically, while the conditions in the image forming process (FIG. 2A) for forming an image on the M sheet 53 by the image formation apparatus 1 are variously changed, the developer deposition amount on the M sheet 53, the optical density, hue and color gamut (so-called gamut) of the image printed on the special medium 55 are observed or measured. The conditions in the image formation process (FIG. 2A) for forming the image by the image formation apparatus 1 are changed by changing the print image density, which represents the density of the textile printing developer in the image formation apparatus 1 to 100[%], 80[%], 60[%], and 40[%].

In the first image forming process (FIG. 2A) in the special medium printing system 50, the conveyance speed of the M sheet 53 in the image formation apparatus 1 (FIG. 1) (i.e., the printing speed) is set at 18 [mm/sec] and the fixation temperature of the fixation unit 30 is set at 160[° C.]. Note that it may be preferable that the fixation temperature of the fixation unit 30 is lower than a temperature at which the textile printing developer is sublimated or a temperature at which the textile printing developer is sublimated and dyes the lustrous developer. An M sheet of WoW 7.8 Textile Transfer manufactured by TheMagicTouch is used as the M Sheet 53. In the image formation apparatus 1, the amount of the lustrous developer adhered on the M sheet 53 (developer deposition amount on the medium) is adjusted to be 0.65 [mg/cm$^2$] by a predetermined operation to set the printing conditions, and the printing process of the print pattern of each color as illustrated in FIGS. 11A to 11D is performed on the M sheet 53 under the set printing conditions. Furthermore, the O.D. (optical density) value, in the case where the print image density, which represents the density of the textile printing developer in the image formation apparatus 1, is set at 100%, is measured by X-Rite 528 (made by X-Rite) under Status I setting using D50 light source, and the bias is adjusted so that the measured O.D. value of each color on Excellent White A4 paper made by Oki Data Corporation is 1.50, and then the printing process is performed.

Here, the print image density is a value that represents the ratio of the number of pixels that transfer the developer to the paper P out of the total number of pixels when the image is broken down in units of pixels. For example, the area ratio of 100% printing, i.e., a solid printing over an entire printable area of a predetermined area (e.g., one round of the photosensitive drum 14, one page of printing media, or the like), is called print image density 100[%], and printing on an area of 1[%] with respect to the print image density 100[%] is called print image density 1[%]. The print image density DPD can be expressed by the following equation (1), using the number of used dots Cm, the number of revolutions Cd, and the total number of dots CO.

$$DPD = \frac{Cm}{Cd \times CO} \times 100[\%] \tag{1}$$

Note that the number of used dots Cm is the number of dots actually used to form the image while the photosensitive drum 14 rotates Cd, and is thus the number of dots exposed by the print head 13 (FIG. 1) during the formation of the image. The total number of dots CO is the total number of dots per rotation of the photosensitive drum 14 (FIG. 1), i.e., the total number of dots that could potentially be used during one rotation of the photosensitive drum 14 regardless of with or without exposure. In other words, the total number of dots CO is the total number of dots used to form a solid image where the developer is transferred to all pixels during one rotation of the photosensitive drum 14. Thus, the value of Cd×CO represents the total number of dots potentially available to form an image during the Cd rotations of the photosensitive drum 14.

For the next first transfer process (FIG. 2B) in the special medium printing system 50, the ironing press temperature, which is the temperature of the heating surface 63S in the ironing press device 51, is set to 185[° C.], the time of the ironing press is set to 45 seconds, and the pressure of the ironing press is set to 4.2 [Kgf/cm$^2$]. Furthermore, in the first transfer process, the M sheet 53 is separated from the T sheet 54 within 5 seconds after the completion of the ironing press.

In a case where the ironing press temperature and the ironing press time specified by TheMagicTouch (the ironing press temperature of 135[° C.], the ironing press time of 45 seconds) are used, the developer layer remains on the M sheet 53, that is, thermal transfer of the image from the M sheet 53 to the T sheet 54 cannot be sufficiently made. Therefore, as illustrated in FIG. 9, the results of thermal transfer while the thermal transfer temperature (ironing press temperature) is changed are evaluated. When the thermal transfer temperature is 185[° C.] or higher, the thermal transfer of the image from the M sheet 53 to the T sheet 54 can be made. Therefore, the ironing press temperature is set to 185[° C.] or higher.

Furthermore, for the second transfer process (FIG. 2C) in the special medium printing system 50, the temperature of the heating surface 63S in the ironing press device 51 (ironing press temperature) is set at 135[° C.], the time of the ironing press is set at 5 seconds, and the pressure of the ironing press is set at 4.2 [Kgf/cm$^2$]. In the second transfer process, a black T-shirt of 100[%] cotton is used as the special medium 55.

[1-4-1. Measurement of Developer Deposition Amount on Medium]

In this measurement, the developer deposition amount on the M sheet 53 is measured by an electronic balance CAP225D made by Sartorius AG.

By the way, an amount of a developer deposited (adhered) on a medium such as paper P or the like is expressed in terms of weight [mg] per unit area, which is 1 [cm$^2$], and thus the unit is [mg/cm$^2$]. This is referred to as a developer deposition amount on a medium. The weight per unit area, which is the developer deposition amount on the medium, is measured and calculated by the following method.

First, a jig made of metal with a flat portion is prepared, and a double-sided tape is applied to a part of the flat portion of the jig that has an area of 1 [$cm^2$]. The weight of the jig is weighed with the aforementioned electronic balance, and then an external power source is used to apply a direct current (DC) voltage of +300 V to the jig.

Figure 10:
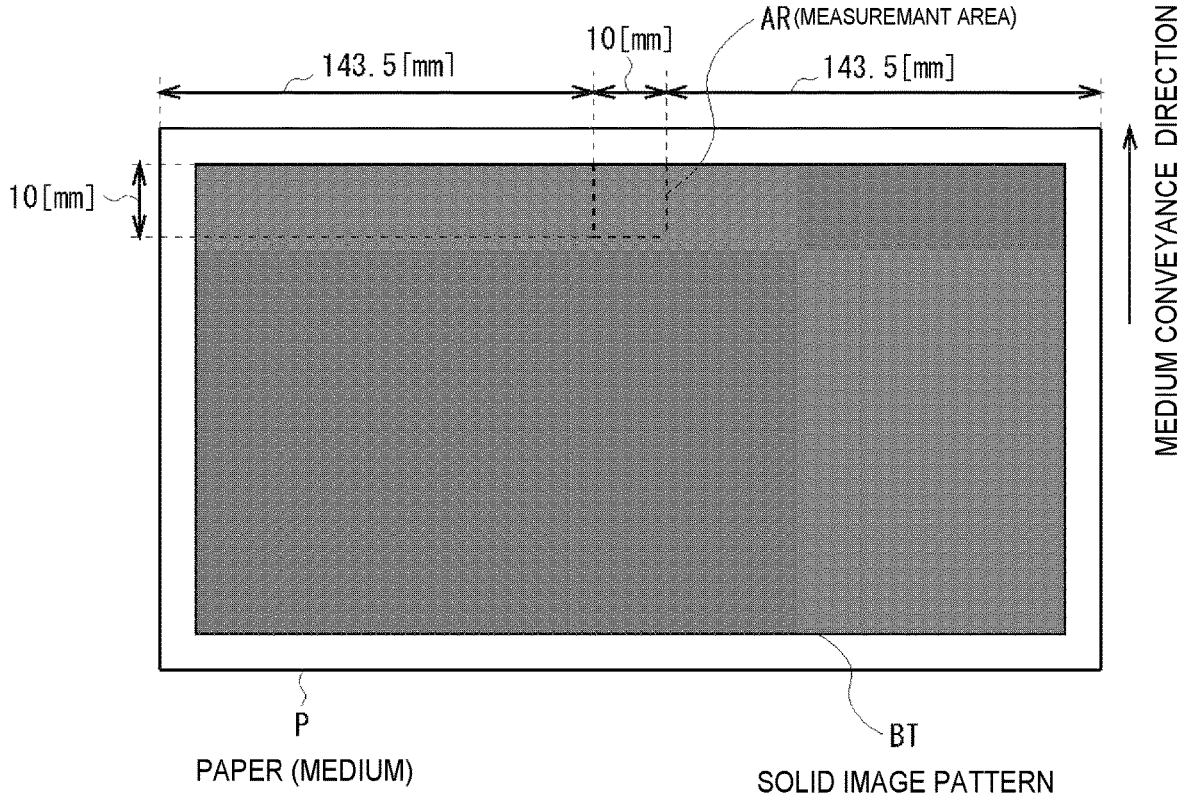
FIG. 10 is a diagram illustrating a measurement area for a developer in a solid image pattern.
Figure 11A:
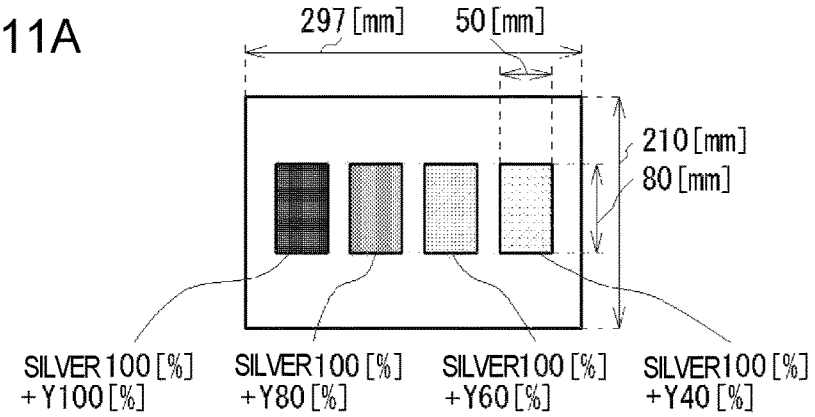
FIGS. 11A to 11D are diagrams illustrating print patterns (1) according to a first embodiment.
Figure 11B:
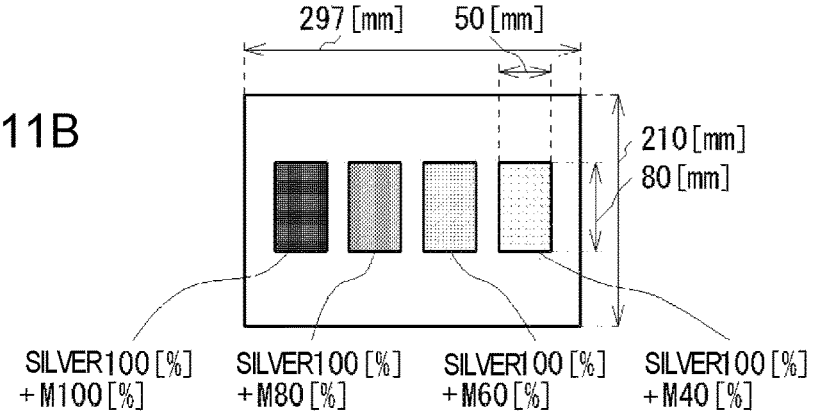
Figure 11C:
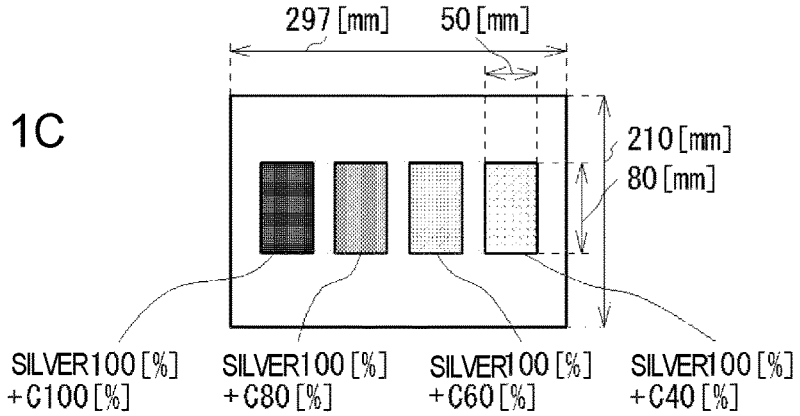
Figure 11D:
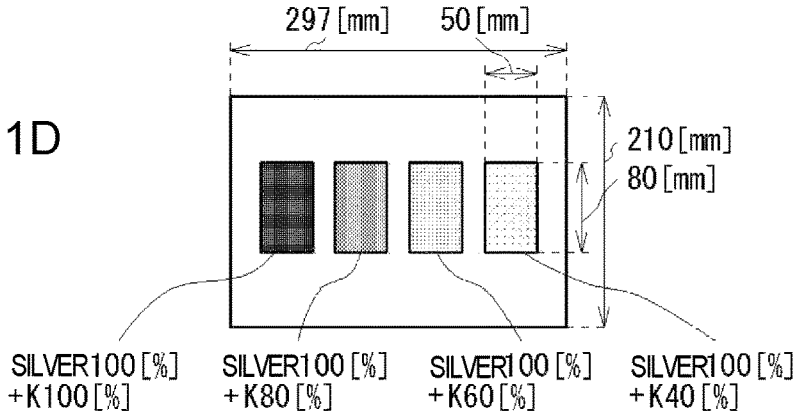

Next, as illustrated in FIG. 10, a medium (i.e., paper P) on which an image pattern (i.e., developer image, hereinafter referred to as a solid image pattern BT) having a print image density of 100[%] is transferred is prepared. The developer on the medium is sampled by pressing the jig once against an area of 10 mm square (hereinafter referred to as measurement area AR), which is approximately in a center in a main scan direction of the medium and near a leading end in a medium conveyance direction (i.e., a sub-scanning direction) of the medium. Note that, the paper P has a length of 297 [mm] in the main scanning direction (in the left-right direction in FIG. 10), which is equivalent to the long side in A4 size or the short side in A3 size. Then, the weight of the jig to which the developer is attached is weighed by the electronic balance. After this weighing is conducted five times, the average value is calculated. Based on the calculated average value, the weight increase by the developer collection is calculated, and the calculated weight increase is converted into a value per unit area, so as to obtain the developer deposition amount on the medium [$mg/cm^2$].

The measurement results, as the developer deposition amount on the medium for each textile printing developer of Example 1, are shown in the tables in FIGS. 13A to 13D. The same measurement is made on color developers supplied with C833 Printer made by OKI Data Corporation, as developers of Comparative Example 1. The measurement results on the color developers of Comparative Example 1 are also shown in the tables in FIGS. 13A to 13D.

[1-4-2. Measurement of Density]

The O.D. value of the image printed on the special medium 55 by the thermal transfer is measured by X-Rite 528 (made by X-Rite). By this measurement, the measurement results on the O.D. value of each developer are obtained as illustrated in the tables illustrated in FIGS. 13A to 13D. The same measurement is made on the developers of Comparative Example 1, and the measurement results are also shown in the tables in FIGS. 13A to 13D.

[1-4-3. Measurement of Hue]

The hue of the image printed on the special medium 55 by the thermal transfer is measured by X-Rite 528 (made by X-Rite). By this measurement, the measurement results on the hue of each developer are obtained as illustrated in the tables illustrated in FIGS. 13A to 13D. The same measurement is made on the developers of Comparative Example 1, and the measurement results are also shown in the tables in FIGS. 13A to 13D.

[1-4-4. Evaluation of Scaly Pattern]

In this evaluation, the image printed on the special medium 55 is visually evaluated to judge if a scaly pattern occurs in the printed image on the special medium 55. The evaluation results are shown in FIGS. 13A to 13D. In the evaluation results shown in FIGS. 13A to 13D, the symbol "○" indicates that there is no scaly pattern, the symbol "Δ" indicates that a scaly pattern occurs on less than ⅓ of the printed surface, and the symbol "X" indicates that a scaly pattern occurs on more than ⅓ of the printed surface.

In the color developers of Comparative Example 1, a scaly pattern occurs in the printed image on the special medium 55 when the deposition amount of the yellow developer on the medium is 0.39 [$mg/cm^2$] or more, when the deposition amount of the magenta developer on the medium is 0.21 [$mg/cm^2$] or more, or when the deposition amount of the cyan developer on the medium is 0.21 [$mg/cm^2$] or more. On the other hand, in the textile printing developers of Example 1, no scaly pattern occurs in the printed image on the special medium 55 even at the maximum developer deposition level on the medium.

[1-4-5. Measurement and Evaluation Under Conditions where No Scaly Pattern Occurs]

Figure 12A:
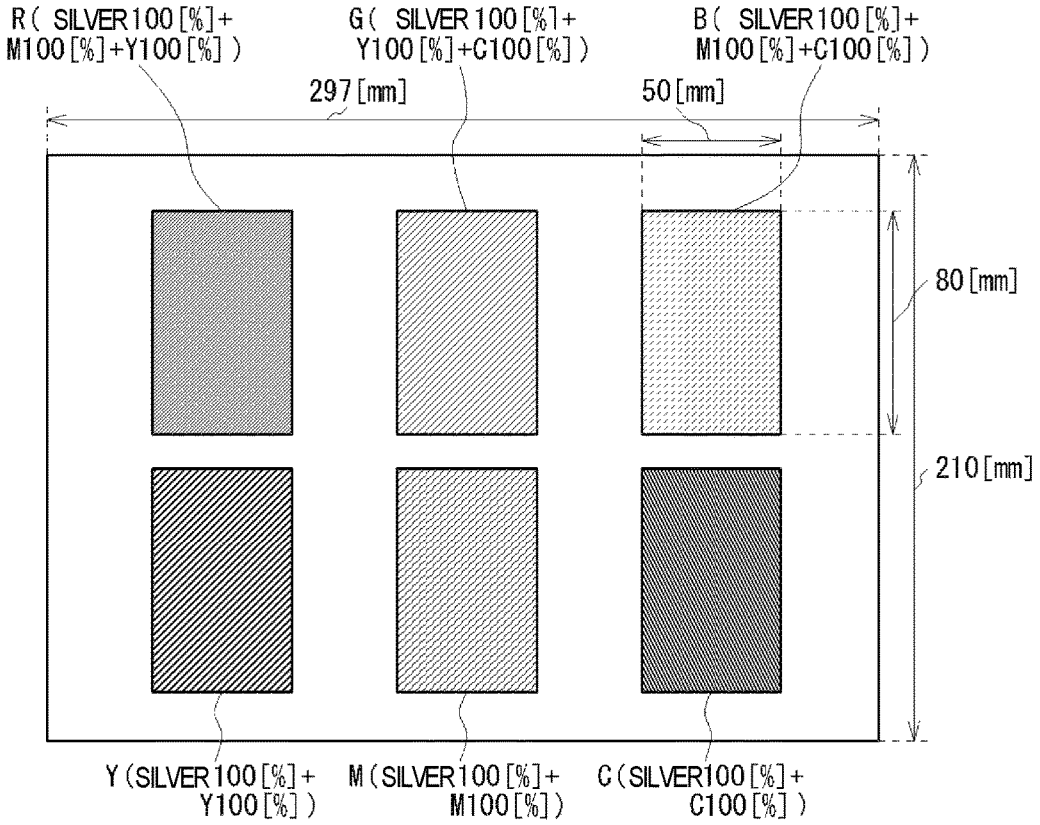
FIGS. 12A and 12B are diagrams illustrating print patterns (2) according to a first embodiment.
Figure 12B:
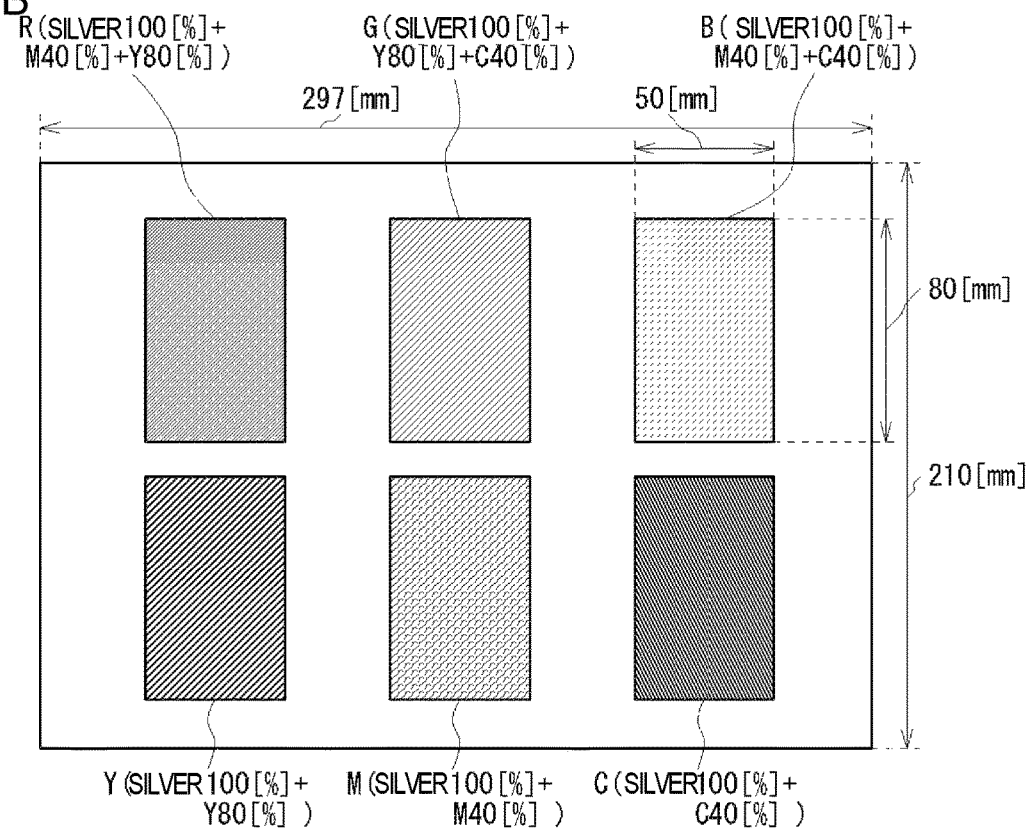
Figure 15:
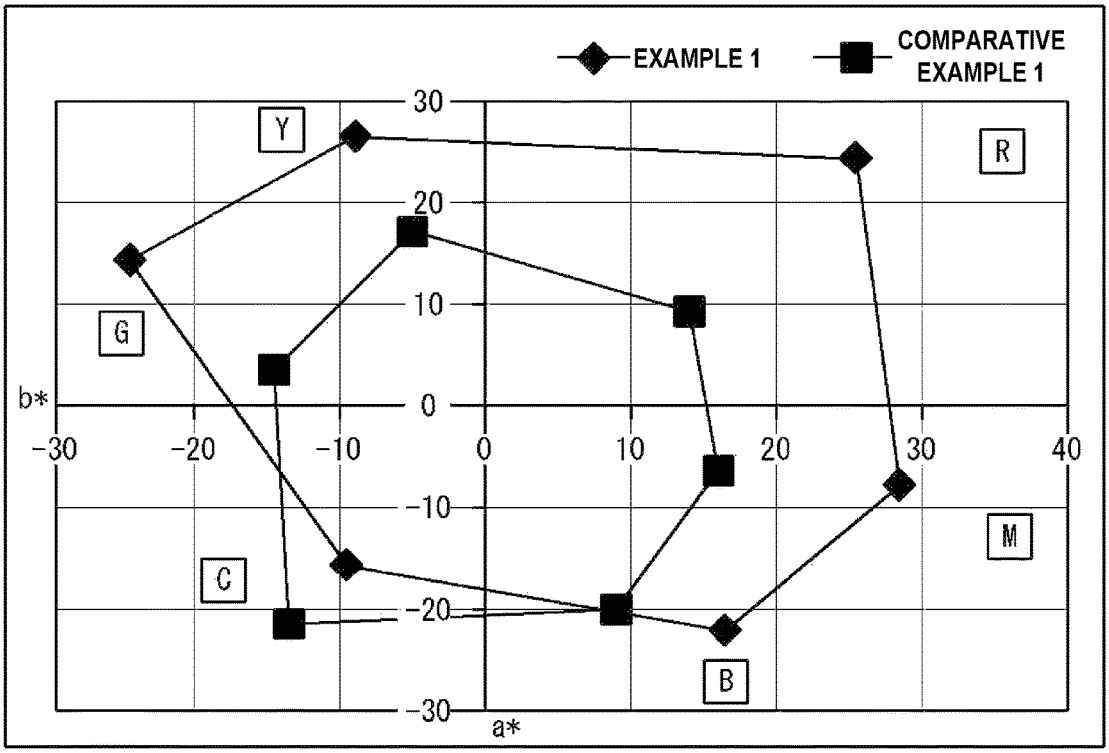
FIG. 15 is a gamut diagram illustrating research results of the color gamut under the conditions in which no scaly pattern has been generated.

In this measurement, a print pattern illustrated in FIG. 12A is printed using the developers of Example 1, and a print pattern illustrated in FIG. 12B is printed using the color developers of Comparative Example 1, with the print image density being adjusted to the largest developer deposition amount on the medium under the condition where no scaly pattern occurs on the special medium. Then, the gamut on the special medium 55 (gamut on the T-shirt) is measured. The measurement results are shown in FIGS. 14 and 15. The measurement results reveal that good color gamut and hue are obtained in the case where the value of the textile printing yellow developer is between 0.05 $mg/cm^2$ and 0.43 $mg/cm^2$, the value of the textile printing magenta developer is between 0.10 $mg/cm^2$ and 0.48 $mg/cm^2$, or the value of the textile printing cyan developer is between 0.26 $mg/cm^2$ and 0.45 $mg/cm^2$.

[1-5. Determination of Developer Deposition Amount on Medium Based on Measurement and Evaluation]

Next, based on the measurement results and the evaluation results described above (FIGS. 13A to 13D, 14, and 15), the deposition amount of each developer on the medium, that attributes a good print result are determined. Based on comparison in the measured gamut on the T-shirt, the good hue and color gamut on the T-shirt are obtained, when the deposition amount of the textile printing yellow developer on the medium (M sheet 53) is 0.05 $mg/cm^2$ or more and 0.43 $mg/cm^2$ or less, the deposition amount of the textile printing magenta developer on the medium (M sheet 53) is 0.10 $mg/cm^2$ or more and 0.48 $mg/cm^2$ or less, the textile printing cyan developer on the medium (M sheet 53) is 0.26 $mg/cm^2$ or more and 0.45 $mg/cm^2$ or less.

[1-6. Effects and Etc.]

In conventional image formation apparatuses, highly glittery metallic color images are expressed on a medium such as paper or the like by superimposing color developers (a color developer layer) and a lustrous developer (a lustrous developer layer). However, in such conventional image formation apparatuses, when large amounts of the color developers are required in order to express a metallic color image on a fabric such as a T-shirt using an iron-on transfer sheet, a printing failure having uneven color, such as a scaly pattern, have occurred in the color developer layer.

Here, since the lustrous developer contains a large amount of metal pigment (such as aluminum) whose particles have a flat shape in order to express a metallic luster, a surface of the lustrous developer layer at the interface between the color developer layer and the lustrous developer layer is considered to be uneven rather than completely smooth. That is, the color developer layer is overlapped with the uneven surface of the lustrous developer layer, and from that state, the M sheet 53 is separated from the T sheet 54.

Also, the color developers of Comparative Example 1 have lower softening points than the textile printing developers according to an embodiment and tend to generate a scaly pattern when large amounts of the color developers are deposited to the medium (that is, when the print image density is high and the thickness of the color developer layer is large) as illustrated in FIGS. 13A to 13D.

Therefore, it is assumed that the reason for the occurrence of the scaly pattern is that, if the thickness of the color developer layer is large, it is difficult, when heat transfer is performed from the M sheet 53 to the T sheet 54 during the ironing press and the color developer layer enters the gap of the uneven lustrous developer layer, for the heat to be transferred to the entire developer layer, and thus the developer layer partially adheres to the M sheet 53 to cause the occurrence of hot offset.

In contrast, if the thickness of the color developer layer is thin in order to inhibit the occurrence of such a scaly pattern, the gamut (FIG. 15) becomes smaller and the expressive color gamut is reduced, making it difficult to express a sufficient metallic color. Specifically, in the case of the developers of Comparative Example 1, a scaly pattern is occurred in the printed image on the special medium unless the developer layer deposited on the medium is made thinner than 0.23 mg/cm$^2$ for the yellow developer, 0.14 mg/cm$^2$ for the magenta developer, 0.15 mg/cm$^2$ for the cyan developer, or 0.13 mg/cm$^2$ for the black developer.

Figure 16A:
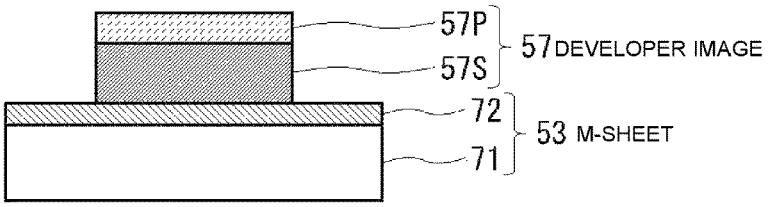
FIGS. 16A to 16E are diagrams illustrating states of dyeing according to a first embodiment.

In contrast, in the special medium printing system 50 according to an embodiment, the image formation apparatus 1 performs the image forming process (FIG. 2A) to form (transfer) the developer image 57 to the M sheet 53 in such a manner that the lustrous developer layer 57S and the textile printing developer layer 57P sequentially stacked on the adhesive layer 72 of the M sheet 53 (FIG. 16A).

Figure 16B:
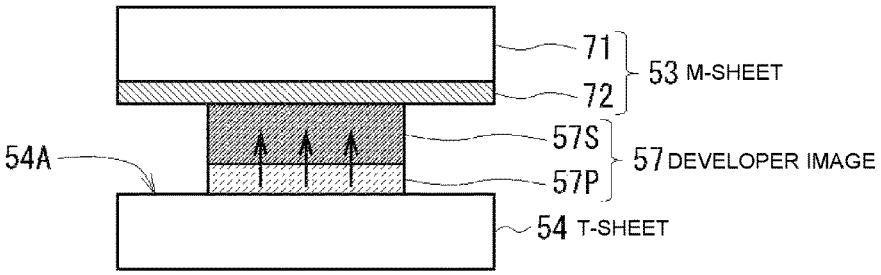

Then, the special medium printing system 50 performs the first transfer process (FIG. 2B) to heat and press the M sheet 53 and the T sheet 54 in the state where the textile printing developer layer 57P of the developer image 57 is in contact with the surface 54A of the T sheet 54. At this time, the heat vaporizes the textile printing dye of the sublimable textile printing developer layer 57P and thus dyes the silver color developer (silver color toner) of the lustrous developer layer 57S, as illustrated in FIG. 16B. Since the resin of the lustrous developer is the polymer compound (e.g., polyester resin) which has the property of being dyeable by the textile printing dye, the lustrous developer is dyed more than when it is composed of other materials. Furthermore, since the resin of the lustrous developer layer 57S is dyed by the textile printing dye of the textile printing developer layer 57P, the glossiness of the lustrous developer layer 57S is retained.

Therefore, in the special medium printing system 50 according an embodiment, by making the amount of the textile printing developer layer 57P deposited to the medium (M sheet 53) reduced (thin layer), it possible to enhance transfer of the heat to the entire developer layer during the ironing press process in the first transfer process, so as to make the textile printing developer layer 57P more tightly hold in the gap of the uneven interface of the lustrous developer layer 57S. Therefore, the developer image 57 and the adhesive layer 72 can be well transferred to the T sheet 54, without generating a scaly pattern in the developer image 57 when the M sheet 53 is separated from the T sheet 54.

Figure 16C:
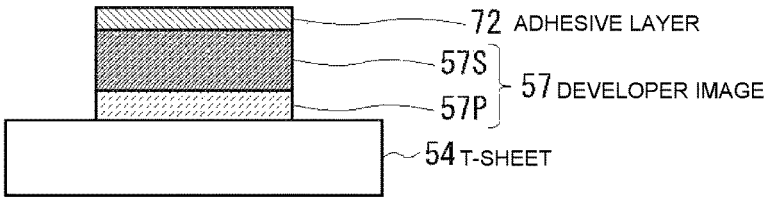

Furthermore, after the separation of the M sheet 53 from the T sheet 54 (FIG. 16C) in the first transfer process, the textile printing developer layer 57P of the developer image 57, and the lustrous developer layer 57S of the developer image 57, and the adhesive layer 72 are sequentially stacked from below on the surface 54A of the T sheet 54.

Figure 16D:
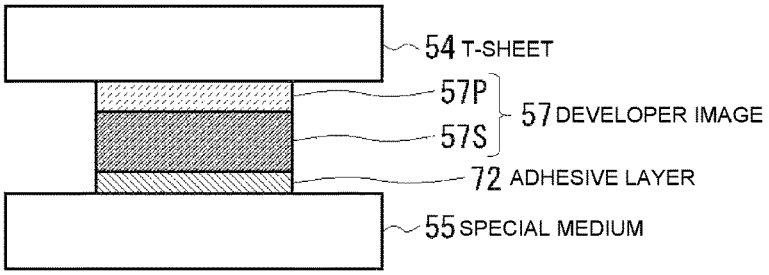
Figure 16E:
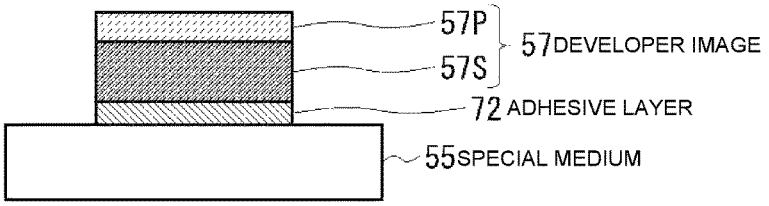

In accordance with this, the developer image 57 having a high image quality without the hot offset (developer residue) can be transferred to the surface of the special medium 55 with the adhesive layer 72 therebetween (FIGS. 16D and 16E) in the second transfer process (FIG. 2C) in the special medium printing system 50.

In this way, the special medium printing system 50 dyes the lustrous developer with the textile printing dyes so as to form the metallic color on the special medium 55. This allows the special medium printing system 50 to form a high-quality color metallic expression on the special medium 55, even with a smaller color developer deposition amount (thinner color developer layer) on the medium (M sheet) compared to the conventional art.

With this, the special medium printing system 50 can form an image on a special medium with reducing a scaly pattern, thereby improving the quality of the image on the special medium.

Figure 17:
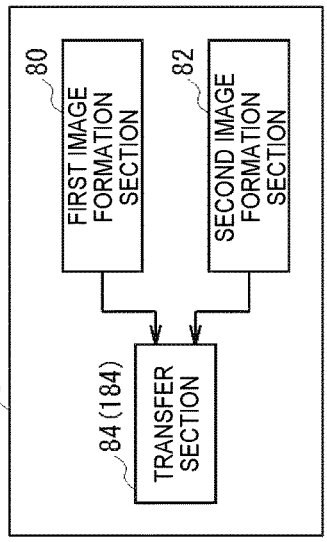
FIG. 17 is a block diagram illustrating a functional configuration of the image formation apparatus.

According to the above configuration, as illustrated in FIG. 17, an image formation apparatus 1 of a special medium printing system 50 according to an embodiment includes: an image formation unit 10S, serving as a first image formation section 80, that forms a lustrous developer layer 57S as a first image using a lustrous developer containing a lustrous pigment; image formation units 10K, 10C, 10M, and 10Y, serving as a second image formation section 82, that form a textile printing developer layer 57P as a second image using a dyeing developer; and a transfer conveyance section 25, serving as a transfer section 84, that transfers the lustrous developer layer 57S and the textile printing developer layer 57P onto an M sheet 53 serving as a medium in such a manner that the lustrous developer layer 57S and the textile printing developer layer 57P are stacked to each other on the M sheet 53.

Further, a method of producing a coloring medium according to an embodiment includes: forming a lustrous developer layer 57S as a first image using a lustrous developer containing a lustrous pigment as a medium, and forming a textile printing developer layer 57P as a second image using a dyeing developer; and superimposing the lustrous developer layer 57S and the textile printing developer layer 57P to each other on an M sheet 53 as a medium.

Accordingly, the special medium printing system 50 can dye the lustrous developer layer 57S with the textile printing developer layer 57P, so that a metallic color can be expressed in an image transferred on the special medium 55 while maintaining the image quality even with the textile printing developer layer 57P being thin, that is, a high quality image can be printed on the special medium 55.

2. Second Embodiment

[2-1. Configuration of Special Medium Printing System]

Figures 19A, 19B, 19C:
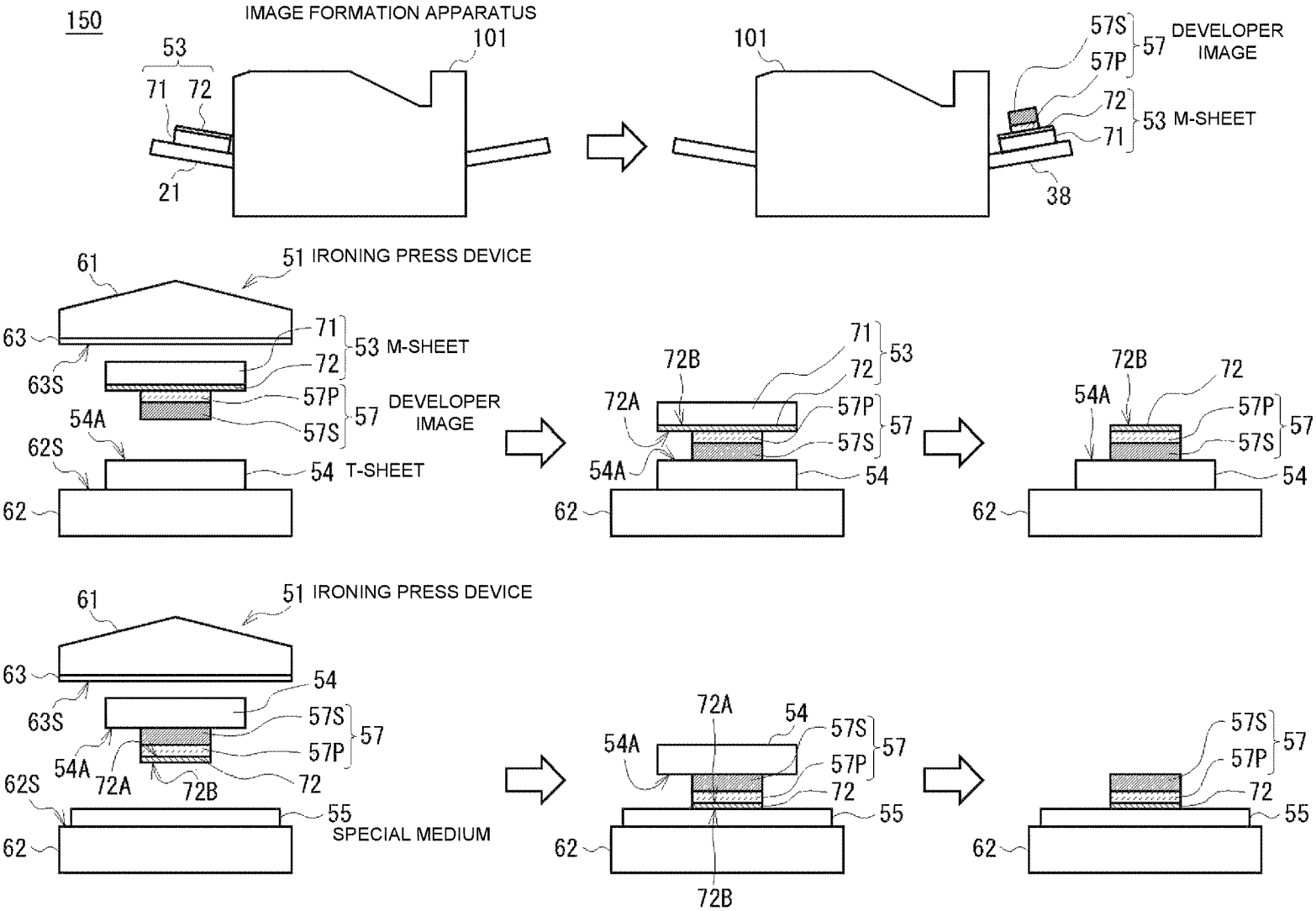
FIGS. 19A to 19C are diagrams illustrating printing of an image by a special medium printing system according to a second embodiment.

As illustrated in FIGS. 19A to 19C, in which the same reference numerals are designated to the components corresponding to those in FIG. 2A to 2C, a special medium printing system 150 according to a second embodiment differs from the special medium printing system 50 according to a first embodiment in having an image formation apparatus 101 that replaces the image formation apparatus 1. Other than that, the special medium printing system 150 has the same configuration as that of the special medium printing system 50.

[2-2. Configuration of Image Formation Apparatus]

Figure 18:
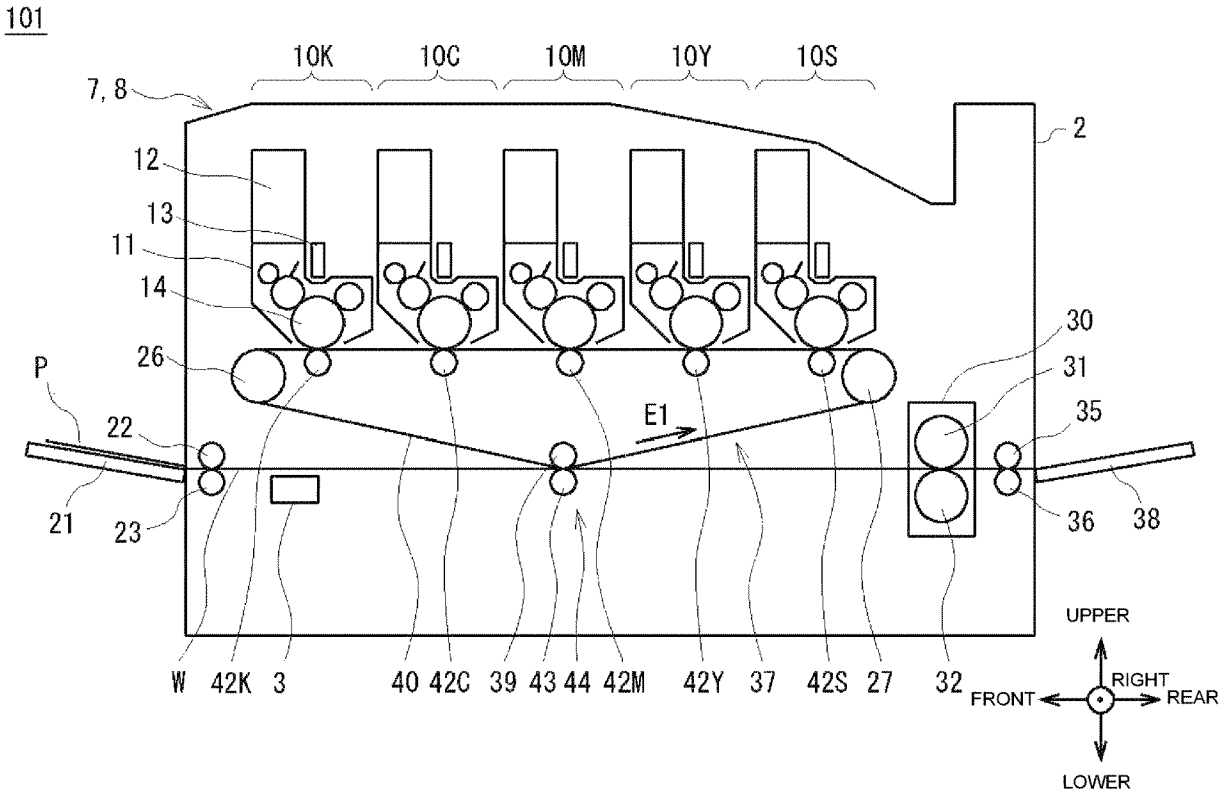
FIG. 18 is a diagram of a right-side view of an image formation apparatus illustrating a configuration of the image formation apparatus according to a second embodiment.

As illustrated in FIG. 18, in which the same reference numerals are designated to the components same as in FIG. 1, the image formation apparatus 101 according to a second embodiment has a different transfer method from that of the image formation apparatus 1 according to a first embodiment. The image formation apparatus 1 (FIG. 1) according to a first embodiment is configured in a so-called direct transfer method, i.e., the image formation apparatus 1 is configured to directly transfer the developer images from the photosensitive drums 14 of the image formation units 10 to the paper P as a medium. In contrast, the image formation apparatus 101 according to a second embodiment has a so-called intermediate transfer method (or secondary transfer method), i.e., the image formation apparatus 101 is configured to primarily transfer the developer images of the respective colors from the photosensitive drums 14 of the image formation units 10 to an intermediate transfer belt 40 and then secondarily transfer the developer images from the intermediate transfer belt 40 to the paper P as a medium.

Specifically, in the image formation apparatus 101 having the intermediate transfer system using the intermediate transfer belt 40, the controller 3 controls a first image formation section (the image formation unit 10S), a second image formation section (the image formation units 10K, 10C, 10M and 10Y), and a transfer section (an intermediate transfer section 37), to form a first image and a second image stacked to each other on the intermediate transfer belt 40, and then transfer the stacked first and second images from the intermediate transfer belt 40 to the paper P, as described in detail below. The intermediate transfer section 37 including transfer rollers 42 (primary transfer parts), the intermediate transfer belt 40, and a secondary transfer part 44 may correspond to a transfer section 184 in FIG. 17 according to an embodiment.

The image formation apparatus 1 (FIG. 1) according to a first embodiment is configured to transfer the developer image 57 to the M sheet 53 in the image forming process (FIG. 2A) in such a manner that the textile printing developer layer 57P is provided above the lustrous developer layer 57S on the M sheet 53. In contrast, the image formation apparatus 101 according to a second embodiment is configured to transfer the developer image 57 to the M sheet 53 in the image forming process (FIG. 19A) in such a manner that the lustrous developer layer 57S is provided above the textile printing developer layer 57P on M sheet 53. Accordingly, the special medium printing system 150 according to a second embodiment transfers the developer image 57 to the special medium 55 in such a manner that the lustrous developer layer 57S is provided above the textile printing developer layer 57P on the special medium 55.

The image formation apparatus 101 (FIG. 18) according to a second embodiment has the intermediate transfer section 37, which replaces the transfer conveyance section 25 of the image formation apparatus 1 (FIG. 1) according to a first embodiment.

The intermediate transfer section 37 is located below the image formation units 10 in the printer housing 2. The intermediate transfer section 37 is provided with a front conveyance roller 26, a rear conveyance roller 27, a backup roller 39, the intermediate transfer belt 40, the five primary transfer rollers 42 (42K, 42C, 42M, 42Y and 42S) and secondary transfer roller 43. Among these, the front conveyance roller 26, the rear conveyance roller 27, the backup rollers 39, the five primary transfer rollers 42 (42K, 42C, 42M, 42Y and 42S) and the secondary transfer rollers 43 are all formed in a cylindrical column shape with their center axis extending along the left-right direction and are rotatably supported by the printer housing 2. For convenience of explanation, the primary transfer rollers 42K, 42C, 42M, 42Y, and 42S may be referred to as primary transfer rollers 42.

The front conveyance roller 26 is located on the front lower side of the image formation unit 10K. The rear conveyance roller 27 is located on the rear lower side of the image formation unit 10S. The upper ends of the front and rear conveyance rollers 26 and 27 are located at the same height as or slightly lower than the lower ends of the photosensitive drums 14 of the image formation units 10. The backup roller 39 is located on the lower rear side of the front conveyance roller 26 and on the lower front side of the rear conveyance roller 27.

The intermediate transfer belt 40 is an endless belt composed of a high resistance plastic film and is wound and strung around the front conveyance roller 26, the rear conveyance roller 27 and the backup roller 39. In the intermediate transfer section 37, the five primary transfer rollers 42 are provided below the upper line of the intermediate transfer belt 40 stretched between the front conveyance roller 26 and the rear conveyance roller 27, that is, the five primary transfer rollers 42 are provided directly below the five image formation units 10 respectively, in such a manner that the five primary transfer rollers 42 are respectively opposed to the five photosensitive drums 14 of the image formation units 10 across the upper line of the intermediate transfer belt 40. Predetermined bias voltages are applied to the primary transfer rollers 42.

The secondary transfer roller 43 is located directly below the backup roller 39 and is biased toward the backup roller 39. That is, in the intermediate transfer section 37, the intermediate transfer belt 40 is sand witched between the secondary transfer roller 43 and the backup roller 39. A predetermined bias voltage is also applied to the secondary transfer roller 43. The secondary transfer roller 43 and the backup roller 39 may be collectively referred to as a secondary transfer part 44.

The intermediate transfer section 37 rotates the front conveyance roller 26 by a driving force supplied from a belt motor (not illustrated), which causes the intermediate transfer belt 40 to run in a direction along the arrow E1 illustrated in FIG. 18. Each primary transfer roller 42 also rotates with the predetermined bias voltage applied. This enables the image formation units 10 to transfer the developer images that have been reached to the lower ends on the circumferential surfaces of the photosensitive drums 14 to the intermediate transfer belt 40, to sequentially superimpose the developer images of the respective colors on the intermediate transfer belt 40. With this, starting with the silver (S) developer image on the most upstream side, the developer images of the respective colors are sequentially superimposed on the surface of the intermediate transfer belt 40.

That is, in the image formation apparatus 101, the developer images of the respective colors (i.e., the lustrous developer image, the textile printing yellow developer image, the textile printing magenta developer image, the textile printing cyan developer image, and the textile printing black developer image) are sequentially transferred from the image formation unit 10S, 10Y, 10M, 10C and 10K. Therefore, when the respective developer images are transferred to the same position of the transfer surface of the intermediate transfer belt 40 by the respective image formation units 10, the silver (S), textile printing yellow (Y), textile printing magenta (M), textile printing cyan (C) and textile printing black (K) developers are sequentially overlaid on the transfer surface of the intermediate transfer belt 40. For convenience of explanation, the textile printing yellow developer image, the textile printing magenta developer image, the textile printing cyan developer image, and the textile printing black developer image may be referred to as textile printing color developer images. The image formation apparatus 101 uses the same lustrous developer, textile printing yellow dyes, textile printing magenta dyes, textile printing cyan dyes and textile printing black dyes as in the image formation apparatus 1.

As the intermediate transfer belt 40 runs (rotates), the developer images that have been formed and transferred to the intermediate transfer belt 40 are moved toward the secondary transfer part 44, while the predetermined bias voltage is applied to the secondary transfer roller 43 of the secondary transfer part 44. Therefore, the secondary transfer part 44 transfers the developer images from the intermediate transfer belt 40 to the paper P being conveyed along the conveyance path W and further conveys the paper P that has the developer images transferred thereon toward the rear direction. Accordingly, when the respective developer images are transferred to the same position of the paper P from the intermediate transfer belt 40, the developers of textile printing black (K), textile printing cyan (C), textile printing magenta (M), textile printing yellow (Y), and silver (S) are sequentially superimposed to each other on the print surface of the paper P. The fixation unit 30 is located on the rear side of the secondary transfer part 44.

In this way, the image formation apparatus 101 forms the developer images by the image formation units 10, primarily transfers the developer images to the intermediate transfer belt 40 by the primary transfer rollers 42 (the primary transfer parts 42), secondarily transfers the developer images from the intermediate transfer belt 40 to the paper P by the secondary transfer part 44, and fixes the developer images to the paper P by the fixation unit 30, thereby printing the image on the paper P (i.e., forming the image on the paper).

[2-3 Configurations of Special Medium Printing System and Each Medium]

Next, forming an image, that is, printing an image, by the special medium printing system 150 is described. As illustrated in FIGS. 19A, 19B and 19C, the special medium printing system 150 includes the above-described image formation apparatus 101 and the ironing press device 51 which is same as in a first embodiment, wherein the M sheet 53, the T sheet 54 and the special medium 55 as media which are the same as in a first embodiment are used.

[2-3-1. Printing Processes]

Next, a detailed procedure of printing processes in the special medium printing system 150 according to a second embodiment is described with reference to FIGS. 19A to 19C, while omitting explanations of the same parts, functions, and the like as in FIGS. 2A to 2C. The printing processes in the special medium printing system 150 is broadly divided into three processes: an image forming process to form an image, a first transfer process to perform a primary transfer process, and a second transfer process to perform a secondary transfer process.

First, as illustrated in FIG. 19A, the special medium printing system 150 according to a second embodiment performs an image formation process, i.e., a printing process, by the image formation apparatus 101, to form the developer image 57 and transfer the developer images to the M sheet 53 as the paper P. This printing process is performed, in the state where the M sheet 53 is placed on the paper feed tray 21 with the transfer surface of the M sheet 53 (i.e., the surface on which the adhesive layer 72 is laminated) facing upward.

In the image formation process (FIG. 19A), the textile printing developer layer 57P of the developer image 57 is formed on the adhesive layer 72 of the M sheet 53, and the lustrous developer layer 57S is stacked on the textile printing developer layer 57P. After the separation of the M sheet 53 from the T sheet 54 in the first transfer process (FIG. 19B), the lustrous developer layer 57S, the textile printing developer layer 57P, the adhesive layer 72 are sequentially stacked from below in that order on the surface 54A of the T sheet 54. Furthermore, in the second transfer process (FIG. 19C), after the separation of the T sheet 54 from the special medium 55, the adhesive layer 72, the textile printing developer layer 57P, and the lustrous developer layer 57S are sequentially stacked from below in that order on the surface of the special medium 55. With this, the printing processes in the special medium printing system 150 is completed.

[2-4. Print Quality Evaluation]

Next, the print quality on the special medium 55 printed by the printing processes of the special medium printing system 150 under various conditions is evaluated. Specifically, while the conditions in the image forming process (FIG. 19A) for forming the image on the M sheet 53 by the image formation apparatus 1 are variously changed, the developer deposition amount on the M sheet 53, the optical density and the F1 value of the image printed on the special medium 55 are observed or measured.

Figure 20:
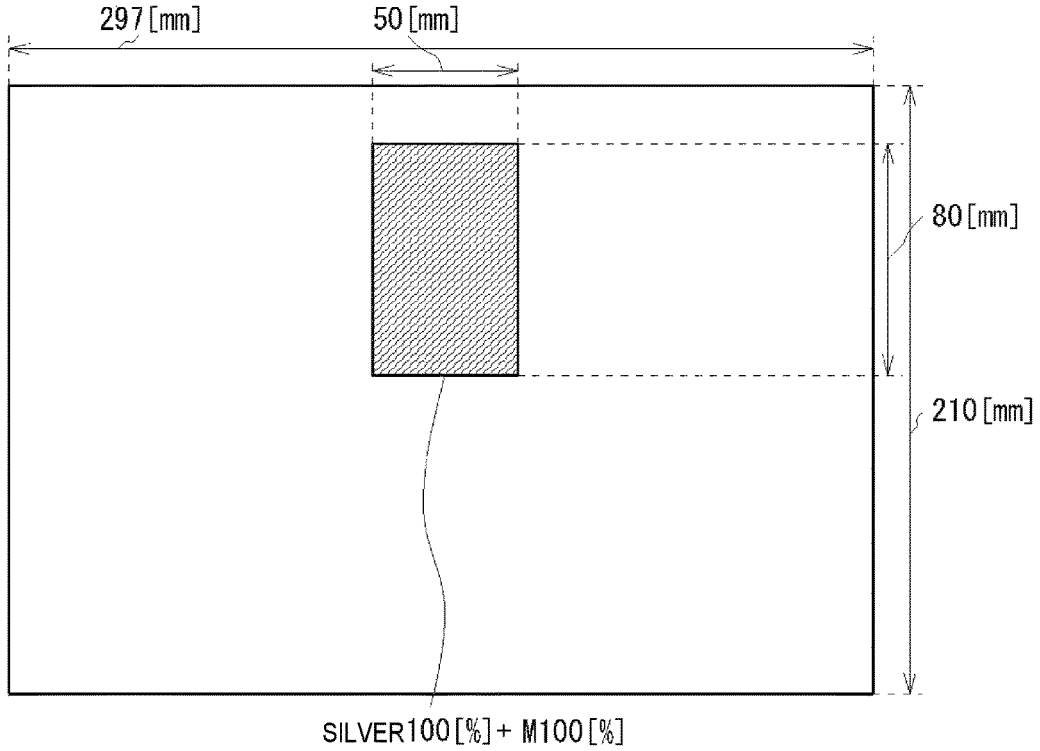
FIG. 20 is a diagram illustrating a print pattern according to a second embodiment.

In the special medium printing system 150, the conveyance speed of the M sheet 53 (i.e., printing speed) in the first image forming process (FIG. 19A) by the image formation apparatus 101 (FIG. 18) is set at 18 [mm/sec] and the fixation temperature (i.e., fusing temperature) of the fixation unit 30 is set at 160[° C.]. M sheet of WoW 7.8 Textile Transfer manufactured by TheMagicTouch is used as the M Sheet 53. The print pattern of the textile printing magenta developer illustrated in FIG. 20 is printed on the M sheet 53 by the image formation apparatus 101. In addition, the O.D. (Optical Density) value in the case where the print image density, which represents the density of the print magenta developer in the image formation apparatus 101, is set to 100[%], is measured by X-Rite 528 (made by X-Rite) and the bias is adjusted so that the O.D. value of each color is 1.50, and then the printing process is performed. Regarding the lustrous developer, as changing the development voltage of the development roller in the image formation unit 10S to fourteen different values, the images of the lustrous developer under the fourteen different development voltages are printed as Example 2-1, Example 2-2, . . . , Example 2-14. In general, when the development voltage of the development roller is set lower, the developer deposition amount on the medium is reduced. For example, if the development voltage is changed from −300 V to −100 V, the developer deposition amount on the medium is reduced.

[2-4-1. Measurement and Evaluation of Density]

Figure 23:
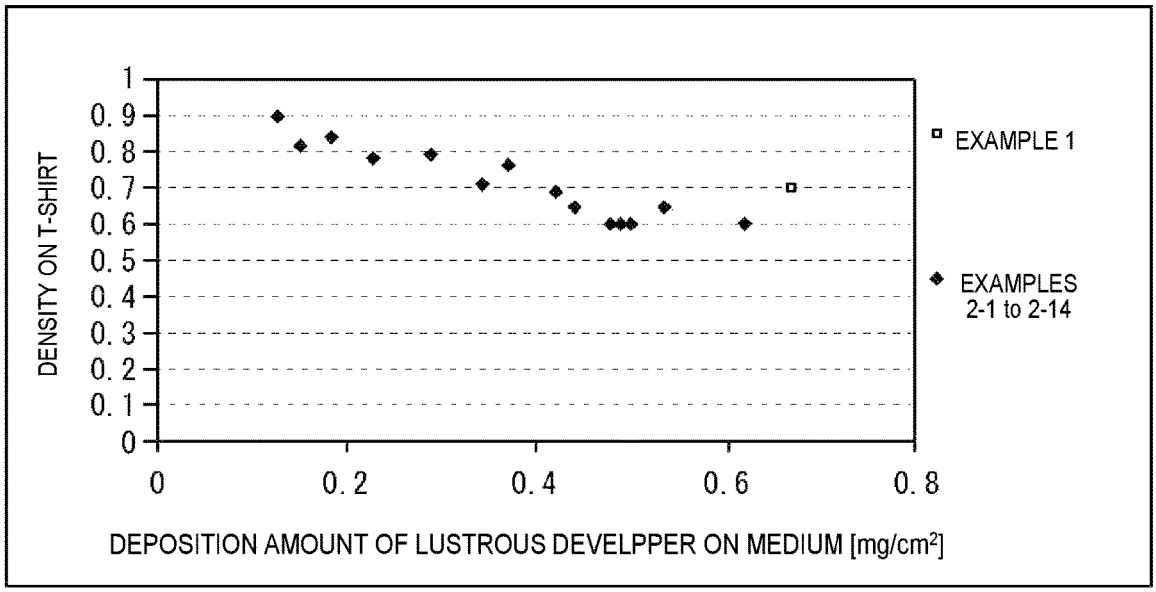
FIG. 23 is a graph illustrating a relationship between the lustrous developer deposition amount on the medium and an image density on a T-shirt.

In this measurement, the O.D. value of the image printed on the special medium 55 for each of Examples 1 and 2-1 to 2-4 is measured by X-Rite 528 manufactured by X-Rite under Status I setting with D50 light source. By this measurement, the O.D. value and the developer deposition amount on the medium of the lustrous developer of each of Examples 1 and 2-1 to 2-4 are obtained as illustrated in the table in FIG. 21. FIG. 23 illustrates the relationship between the developer deposition amount on the medium of the lustrous developer and the density of the image printed on the T-shirt obtained for each of Examples 1 and 2-1 to 2-4 by this measurement.

The density of the image printed on the special medium 55 is evaluated, and the evaluation results of the density are shown in FIG. 21. In the evaluation results of the density shown in FIG. 21, the symbol "0" indicates that the obtained density is greater than or equal to the density of the image obtained in Example 1, and the symbol "X" indicates that the obtained density is less than the density of the image obtained in Example 1.

[2-4-2. Measurement and Evaluation of Metallicity (Lustrousness)]

Figure 22:
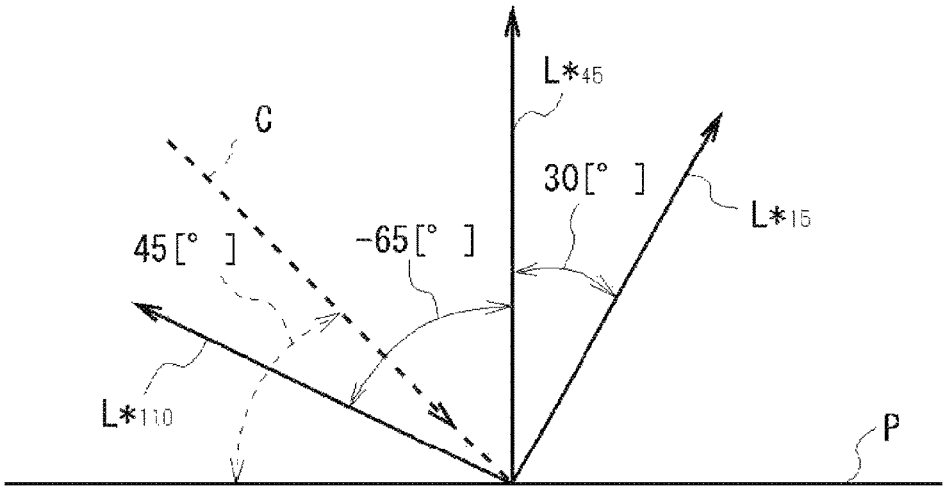
FIG. 22 is a diagram illustrating light emission and reception by a variable angle photometer.
Figure 24:
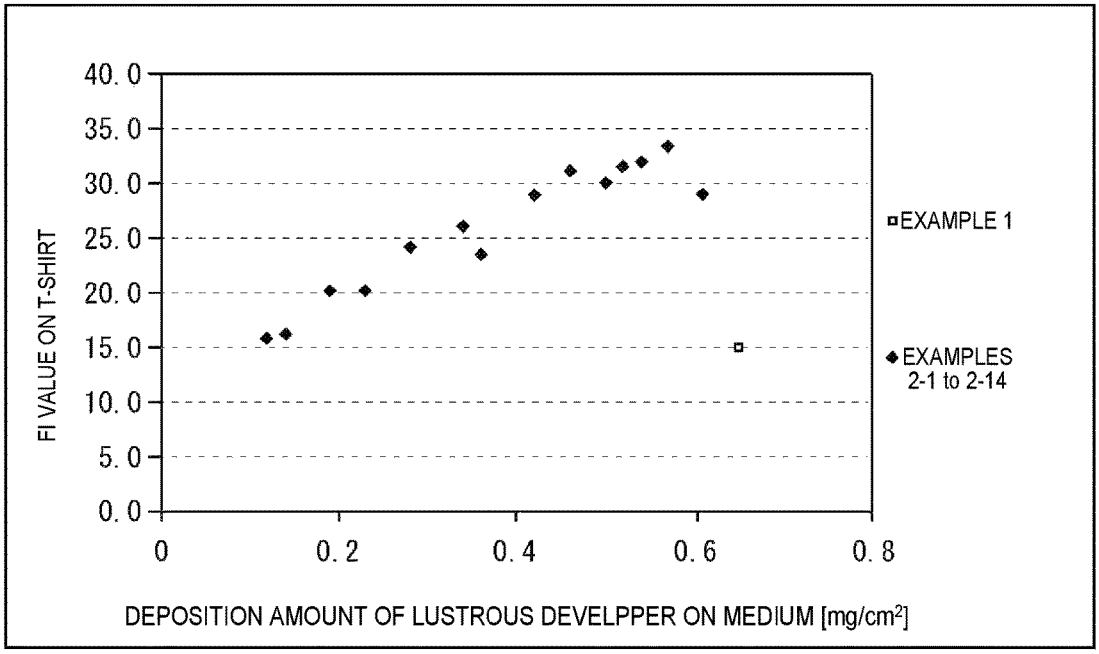
FIG. 24 is a graph illustrating a relationship between the lustrous developer deposition amount on the medium and an FI value on the T-shirt.

In this measurement, the lustrousness is measured using Variable Angle Photometer GC-5000 manufactured by Nippon Denshoku Inductries Co., Ltd. Specifically, as illustrated in FIG. 22, the image printed on the special medium 55 as the paper P is irradiated by the variable angle photometer by emitting light C to the image printed on the special medium 55 in a direction of 45[°] with respect to the surface of the special medium 55. The light reflected from the image printed on the special medium 55 is received at the direction of 45 [°], 15[°] and 110[°] with respect to a direction orthogonal to the direction of the light C. Based on the results of the received light at the angles of 45 [°], 15[°] and 110[°], the brightness indexes of $L^*_{45}$, $L^*_{15}$, and $L^*_{110}$ are calculated. Next, in this evaluation, the flop index FI is calculated by substituting each calculated brightness index into the following equation (2), to measure the lustrousness of the image. The relationship between the developer deposition amount on the medium for the lustrous developer and the FI value on the T-shirt obtained from this measurement is illustrated in FIG. 24.

$$FI = 2.69 \times \frac{(L*_{15} - L*_{-110})^{1.11}}{(L*_{45})^{0.86}} \quad (2)$$

The flop index FI indicates that when the value the flop index FI is high the lustrousness is high and when the value of the flop index FI is low the lustrousness is low.

Also, in this evaluation, the metallicity of the images printed on the special medium 55 is evaluated, and the evaluation results on the metallicity are illustrated in FIG. 21. The evaluation results of the metallicity are marked with the symbol "0" when the FI value is not less than the flop index FI obtained in Example 1 and with the symbol "X" when the FI value is less than the flop index FI obtained in Example 1.

[2-5. Determination of Developer Deposition Amount on Medium Based on Measurement and Evaluation]

Next, based on the results (FIG. 21) of the various measurements and evaluations described above, the deposition amount of the lustrous developer on the medium that attributes a good print result are determined. Based on comparison in the density judgment shown in FIG. 21, when the developer deposition amount on the medium of the lustrous developer, which is the amount of the lustrous developer adhered to the M sheet 53 as the medium, is not less than 0.12 [mg/cm$^2$] and not more than 0.36 [mg/cm$^2$], the image density on the special medium 55 is higher than that in Example 1. Based on comparison in the metallicity judgment shown in FIG. 21, when the deposition amount of the lustrous developer on the medium is 0.12 [mg/cm$^2$] or more and 0.61 [mg/cm$^2$] or less, the FI value on the special medium 55 is higher than that in Example 1. For this reason, in Examples 2, it can be seen that a high density and a high FI value for the image formed on the special medium 55 can be obtained at the same time, by setting the amount of the lustrous developer as the uppermost layer on the medium to 0.12 [mg/cm$^2$] or more and 0.36 [mg/cm$^2$] or less.

[2-6. Effects and Etc.]

In the image formation apparatus 1 (FIG. 1) according to a first embodiment described above, although the density of the image printed on the special medium 55 is good, the base resin of the textile printing developer remaining on the lustrous developer layer 57S at the time of the thermal transfer tends to inhibit the lustrousness (FI value) of the lustrous developer, so as to tend to lower the FI value.

Figure 25A:
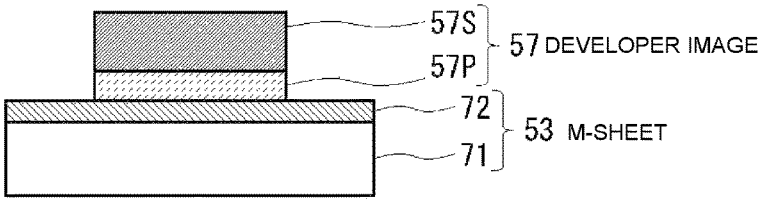
FIGS. 25A to 25E are diagrams illustrating states of dyeing according to a second embodiment.

In contrast, in the special medium printing system 150 according to a second embodiment, the image formation apparatus 101 performs the image forming process (FIG. 19A) to transfer the developer image 57 to the M sheet 53 such that the textile printing developer layer 57P and the lustrous developer layer 57S sequentially stacked from below in that order on the adhesive layer 72 of the M sheet 53 (FIG. 25A).

Figure 25B:
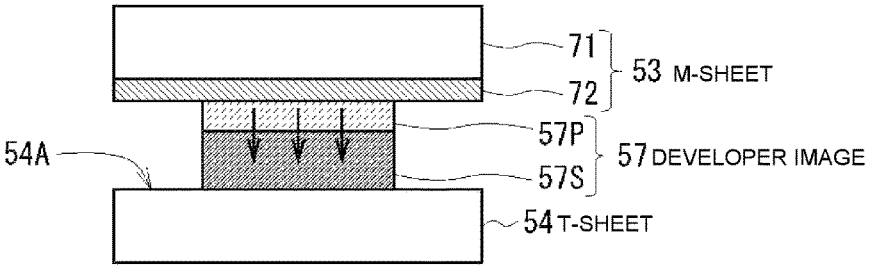

Then, in the special medium printing system 150, the ironing press device performs the first transfer process (FIG. 19B) to heat and presses the M sheet and the T sheet stacked each other with the developer image 57 therebetween in the state where the lustrous developer layer 57S of the developer image 57 is in contact with the surface 54A of the T sheet 54. At this time, as illustrated in FIG. 25B, the heat vaporizes the textile printing dye of the sublimable textile printing developer layer 57P and thus the vaporized dye dyes the silver color developer (silver color toner) of the lustrous developer layer 57S.

Figure 25C:
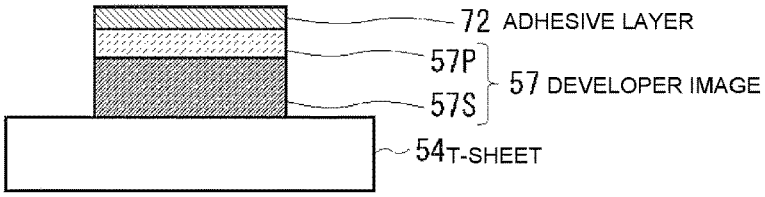

Note that, after the separation of the M sheet 53 (FIG. 25C) from the T sheet 54 in the first transfer process, the lustrous developer layer 57S, the textile printing developer layer 57P, and the adhesive layer 72 are sequentially stacked from below in that order on the surface 54A of the T sheet 54.

Figure 25D:
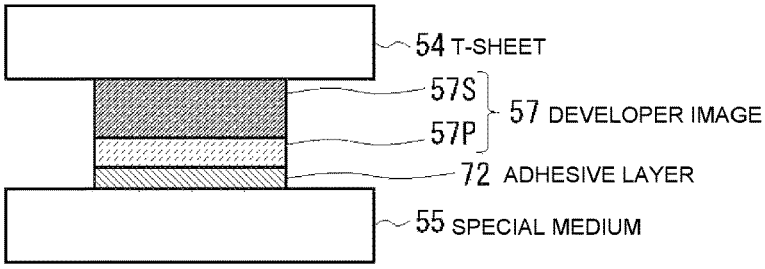
Figure 25E:
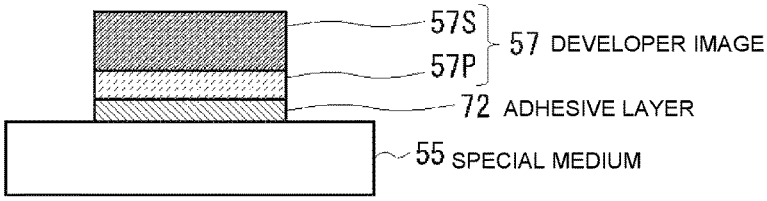

In accordance with this, in the special medium printing system 150, the developer image 57 having a high image quality without the hot offset (developer residue) can be transferred to the surface of the special medium 55 with the adhesive layer 72 therebetween (FIGS. 25D and 25E) in the second transfer process (FIG. 19C).

In this way, the special medium printing system 150 according to a second embodiment forms the developer image 57 on the special medium 55, which is the final medium on which the image is finally formed, in such a manner that the textile printing developer layer 57P containing the sublimable disperse dye is provided above the lustrous developer layer 57S on the special medium 55. In other words, the special medium printing system 150 overlays the textile printing developer layer 57P and the lustrous developer layer 57S to each other on the special medium 55 in such a manner that the lustrous developer layer 57S is most distant from the special medium 55. Thus, in the special medium printing system 150, the lustrous developer layer 57S is formed as the uppermost layer on the final medium, so that the base resin of the textile printing developer does not interfere with the lustrousness (FI value) of the lustrous developer, and thus the density and FI value of the image on the final medium can be increased. This enables the special medium printing system 150 to produce the fabric printed matter with the higher print density and higher metallicity than the special medium printing system 50.

In addition, in general, a lustrous developer has a high concealment, and thus the lustrous developer strongly inhabits coloration of a developer layer formed underneath the lustrous developer, resulting in deterioration of expression of the color gamut. To the contrary, the special medium printing system 150 according to a second embodiment can obtain a high image density on the final medium, because the textile printing developer containing the sublimable disperse dye dyes the lustrous developer layer 57S provided above the textile printing developer.

The special medium printing system 50 according to a first embodiment described above can express good metallic color on the T-shirt using the iron-on transfer paper (iron-on transfer sheet), but may not be able to express good metallic color on plain paper without using the iron-on transfer paper.

To the contrary, in the special medium printing system 150 according to a second embodiment, the image formation apparatus 101 can express good metallic color even on plain paper, by forming the developer image 57 on the plain paper in such a manner that the lustrous developer layer 57S is provided above the textile printing developer layer 57P on the pain paper, without using the ironing press device 51. For example, in a case where the image formation apparatus 101 of the special medium printing system 150 raises the temperature of the heating roller 31 of the fixation unit 30 during a metallic color printing and slows down the printing speed (i.e., slows down the speed at which the plain paper passes through the fixation unit 30), the textile printing dyes contained in the textile printing developer can be sublimated to dye the lustrous developer layer on the plain paper at the time of fixation process of the fixation unit 30. This allows the image formation apparatus 101 of the special medium printing system 150 to obtain a printed matter having an image on the plain paper with high image density and lustrousness (FI value). Note that although the evaluations on the textile printing magenta developer is only explained above, the yellow, cyan, and black textile printing developers can also have similar effects.

According to the above configuration, as illustrated in FIG. 17, an image formation apparatus 101 in a special medium printing system 150 according to a second embodiment includes: an image formation unit 10S, serving as a first image formation section 80, that forms a lustrous developer layer 57S as a first image using a lustrous developer containing a lustrous pigment; image formation units 10K, 10C, 10M and 10Y, serving as a second image formation section 82, that form a textile printing developer layer 57P as a second image using a dyeable developer; and a transfer section 184 (an intermediate transfer section 37) that transfers the lustrous developer layer 57S and the textile printing developer layer 57P onto the printing medium such that lustrous developer layer 57S and the textile printing developer layer 57P are stacked to each other on the printing medium.

3. Other Embodiments

Figure 26:
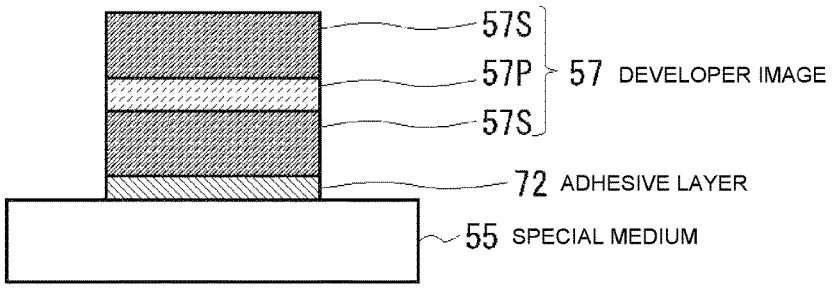
FIG. 26 is a diagram illustrating a configuration of a developer image on a special medium according to another embodiment.

In a second embodiment described above, the case has been described where the developer image 57 is transferred onto the special medium 55 in such a manner that the lustrous developer layer 57S is overlaid on the upper side of the textile printing developer layer 57P on the special medium 55. However, the disclosure is not limited thereto. For example, as illustrated in FIG. 26, a developer image 57 may be formed on a special medium 55, in such a manner that a first lustrous developer layer 57S is overlaid on a textile printing developer layer 57P, and a second lustrous developer layer 57S is overlaid under the textile printing developer layer 57P. In this case, the image density on the final medium can be slightly better than that in a second embodiment described above.

In a first embodiment described above, the case has been described where the developer image 57 is transferred onto the special medium 55 in such a manner that the textile printing developer layer 57P is overlaid on the lustrous developer layer 57S on the special medium 55. However, the disclosure is not limited thereto. For example, a developer image 57 may be formed on a special medium 55 in such a manner that a first textile printing developer layer 57P is overlaid on a lustrous developer layer 57S, and a second textile printing developer layer 57P is overlaid under the lustrous developer layer 57S.

Furthermore, in one or more embodiments described above, the case has been described where the lustrous developer is the silver-colored developer that contains the aluminum as the lustrous pigment, which is added at the time of manufacturing thereof. However, the disclosure is not limited thereto. For example, a lustrous developer may a gold-colored developer (gold toner) that contains a yellow pigment (for example, C.I. Pigment Yellow 180 as an organic pigment), a magenta pigment (for example, C.I. Pigment Red 122 as an organic pigment), lustrousred-orange fluorescent dye (for example, FM-34N_Orange made by Shinrohi Corporation), and yellow fluorescent dye (for example, FM-35N_Yellow made by Shinrohi Corporation) in addition to a lustrous pigment, which are added at the time of manufacturing thereof.

In one or more embodiments described above, the case of forming the release side 71A by coating the surface of the backing sheet 71 with the release agent has been described (FIG. 3A). The disclosure is not limited thereto. For example, if the material of the backing sheet 71 has properties that allow the adhesive medium (i.e., adhesive layer 72) to be easily peeled off, the release side 71A may be formed without coating it with a release agent.

Further, in one or more embodiments described above, the case has been described where the surface roughness of the contact surface 72B of the adhesive layer 72 of the M sheet 53 is greater than that of the developer transfer surface 72A of the adhesive layer 72 of the M sheet 53 (FIGS. 4A and 4B). The disclosure is not limited thereto. For example, the surface roughness of the developer transfer side 72A and the contact side 72B of the adhesive layer 72 may be equally set. Also, the adhesive layer 72 is not limited to the configuration with the thickness of 40.0 [μm], but may have another thickness. In this case, it is preferable that the thickness of the adhesive layer 72 is 20 to 80 [μm] and the thickness of the M sheet 53 including the adhesive layer is 100 to 160 [μm], taking into account that the M sheet 53 should be conveyable inside the image formation apparatus 1 or 101, the ironing press device 51 finally transfers and binds the developer image 57 to the special medium 55, and etc. Furthermore, the adhesive layer 72 does not have to be lipophilic in a modification.

Figures 27A, 27B, 27C:
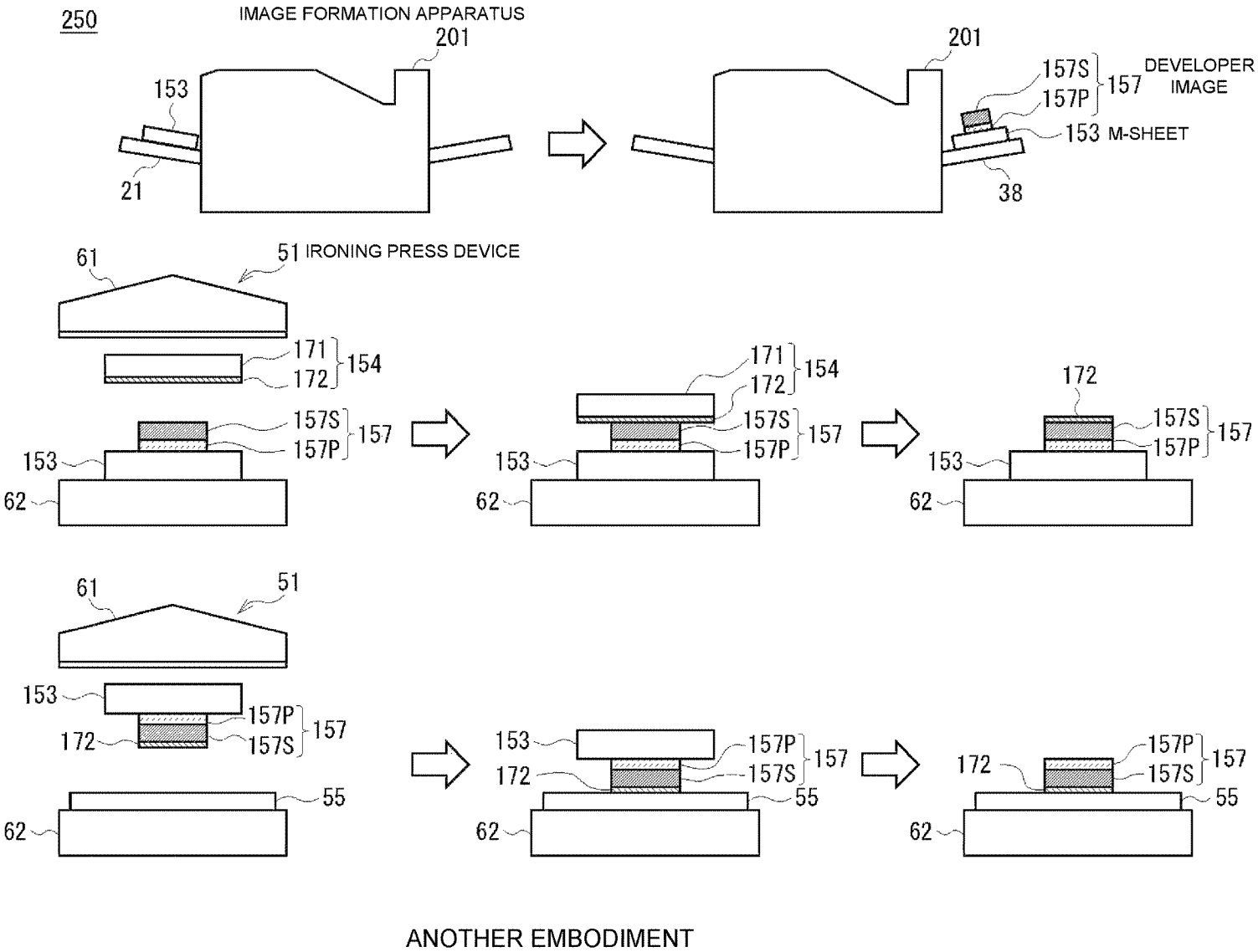
FIGS. 27A to 27C are diagrams illustrating printing of an image by a special medium printing system according to another embodiment.

Further, in one or more embodiments described above, the case has been described where the M sheet 53 (FIG. 3A) that includes the backing sheet 71 and the adhesive layer 72 laminated on the backing sheet 71 is used, in order to transfer the developer image 57 onto the M sheet 53 in the image forming process (FIG. 2A) by the image formation apparatus 1. However, the disclosure is not limited thereto. For example, a transfer paper 153 and a glue sheet 154 may be used in place of the M sheet 53 and the T sheet 54, such as being illustrated as a special medium printing system 250 in FIGS. 27A to 27C, which correspond to FIGS. 2A to 2C.

For example, the transfer paper 153 may be TTC 3.1 Heat Transfer Paper manufactured by TheMagicTouch, which has a configuration similar to the T sheet 54 described above. That is, the transfer paper 153 does not have an adhesive layer 72. To the contrary, the glue sheet 154 may be, for example, Laser-Dark B-Paper manufactured by Forever, which has a configuration similar to the M sheet 53 described above, and has an adhesive layer 172 laminated to a backing sheet 171.

In this special medium printing system 250, a first image forming process (FIG. 27A) is performed by an image formation apparatus 201 in place of the image formation apparatus 1, and then a first transfer process (FIG. 27B) and a second transfer process (FIG. 27C) are performed sequentially by the ironing press device 51.

In the image formation apparatus 201, unlike the image formation apparatus 1, the image formation unit 10S, which forms the silver-colored developer image, is located at the most downstream side. With this configuration, in the special medium printing system 250, when a developer image 157 is formed on the transfer paper 153 by the image formation apparatus 201 in the image forming process (FIG. 27A), a textile printing developer layer 157P is formed directly on the transfer paper 153, and a lustrous developer layer 157S is stacked on the textile printing developer layer 157P.

Then, in the first transfer process (FIG. 27B) of the special medium printing system 250, in a state where the glue sheet 154 is placed on the transfer paper 153 in such a manner that the adhesive layer 172 of the glue sheet 154 is in contact with the developer image 157 of the transfer paper 153, the ironing press device 51 performs ironing press by applying heat and pressure for 45 seconds at the temperature of 85[° C.] and the pressure of 4.2 [kgf/cm$^2$]. Then, by pulling (peeling) the glue sheet 154 off the transfer paper 153, the adhesive layer 172 is left on and bonded to the developer image 157 on the transfer paper 153.

Then, in the second transfer process (FIG. 27C) in the special medium printing system 250, in a state where the transfer paper 153 is flipped over and placed on a special medium 55 such that the adhesive layer 172 is in contact with the special medium 55, the ironing press device 51 performs ironing press by applying heat and pressure for 5 seconds at the temperature of 135[° C.] and the pressure of 4.2 [kgf/cm$^2$]. Thereafter, when the transfer paper 153 is pulled off the special medium 55, the developer image 157 remains on and is bonded to the special medium 55 by means of the adhesive layer 172 in such a manner that the textile printing developer layer 157P is stacked above the lustrous developer layer 157S on the special medium 55. In this way, the special medium printing system 250 can print an image in which the gradation is well expressed on the special medium 55 by using the transfer paper 153 and the glue medium 154.

Furthermore, in one or more embodiments described above, the case has been described in which the image formation apparatus prints the image including the lustrous developer and the textile printing developer on the paper P, by performing a single fixation of the lustrous developer and the textile printing developer together by the fixation unit 30. However, the disclosure is not limited thereto. For example, the image formation apparatus may print an image including a lustrous developer and a textile printing developer on paper P, by performing fixation processes two times in which the lustrous developer and the textile printing developer are fixed separately. In that case, a fixation temperature for the lustrous developer and a fixation temperature for the textile printing developer may be set different to each other. For example, the image formation apparatus may perform fixation processes two times, by forming the lustrous developer on a medium, primarily fixing the lustrous developer onto the medium at a fixation temperature of 150[° C.] in the fixation unit, re-conveying the medium having the lustrous developer through a return path, forming the textile printing developer on the lustrous developer on the medium, and secondarily fixing the textile printing developer on the medium at a fixation temperature of 130[° C.] in the fixation unit. Note that since the textile printing dye of the textile printing developer has characteristics to be sublimated when heated, it may be preferable to lower the fixation temperature set for the textile printing developer to as close as possible to the lowest temperature in which the textile printing developer can be fixed, unlike the lustrous developer.

Furthermore, in a first embodiment described above, the case has been described where the image is finally printed on the T-shirt as the special medium 55 (the final medium) (FIGS. 2A to 2C). However, the disclosure is not limited to this. For example, an image may be finally printed on any other special media, for example, any materials to which the adhesive layer 72 can be bonded by heat and pressure by the ironing press device 51, such as a fabric bag, curtain, or the like. Further, an image may be finally printed on any other special media, such as a large metal plate, a heat resistant plastic plate, or the like, which are extremely difficult to convey along the conveyance path W in the image formation apparatus 1 or is virtually impossible to have the developer image directly transferred by the image formation apparatus 1. In particular, since a scaly pattern is considered to occur in a process of peeling the M sheet 53 from the T sheet 54 after applying heat and pressure to the developer layers, the application of the invention to such a special medium printing system 50 may result in remarkable effects. The same is true for a second embodiment described above.

Furthermore, in one or more embodiments described above, the case has been described where the invention is applied to the developer of the single component development type. However, the disclosure is not limited thereto. For example, the invention may be applied to a developer of a two-component development type, which provides an appropriate amount of charge to the toner by mixing a carrier and the toner, using friction between the carrier and the toner.

Furthermore, in one or more embodiments described above, the case has been described where the five image formation units 10 are provided in the image formation apparatus 1 or 101 (FIG. 1 or FIG. 18). However, the disclosure is not limited thereto. For example, the image formation apparatus 1 or 101 may be provided with less than or more than five image formation units 10.

Furthermore, in one or more embodiments described above, the case has been described where the invention is applied to the image formation apparatus 1 or 101, which is a single function printer. The invention is not limited thereto, and may be applied to an image formation apparatus having various other functions, such as an MFP (Multi-Function Peripheral) having functions of a copier or a facsimile, for example.

Further, in one or more embodiments described above, the case of applying the invention to the image formation apparatus 1 or 101 has been described. However, the disclosure is not limited thereto. For example, the invention may be applied to various electronic devices such as photocopiers and the like, which form images on paper P or other media using developers by an electrophotographic method.

Furthermore, the invention is not limited to one or more embodiments described above. That is, the application range of the invention covers embodiments obtained by arbitrarily combining some of or all of embodiments described above and the other embodiments described above as well as embodiments obtained by extracting a part of the embodiments described above. That is, in a first embodiment, the developer image 57 may be transferred to a special medium 55 in such a manner that a lustrous developer layer 57S is provided above a textile printing developer layer 57P on the special medium 55, as in a second embodiment. Further, in a second embodiment, a developer image 57 may be transferred to a special medium 55 in such a manner that a textile printing developer layer 57P is provided above a lustrous developer layer 57S on the special medium 55, as in a first embodiment.

Furthermore, in a first embodiment described above, the case has been described in which the image formation apparatus 1 includes the first image formation section 80 as the first image formation section, the second image formation section 82 as the second image formation section, and the transfer section 84 (transfer conveyance section 25) as the transfer section. However, the invention is not limited thereto. For example, an image formation apparatus may include a first image formation section, a second image formation section, and a transfer section that have configurations different from those in a first embodiment described above.

Furthermore, in a second embodiment described above, the case has been described in which the image formation apparatus 101 includes the first image formation section 80 as the first image formation section, the second image formation section 82 as the second image formation section, and the transfer section 184 (intermediate transfer section 37) as the transfer section. However, the invention is not limited thereto. For example, an image formation apparatus may include a first image formation section, a second image formation section, and a transfer section that have configurations different from those in a second embodiment described above.

The invention can be used in cases where an electrophotographic image formation apparatus is used to print images on a special medium.

The invention includes other embodiments or modifications in addition to the above-described one or more embodiments and one or more modifications without departing from the spirit of the invention. The one or more embodiments and one or more modification described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a first image formation section including a first photosensitive member configured to form a first image of a developer containing a metallic pigment and a dyeable polymer compound;

a second image formation section including a second photosensitive member configured to form a second image of a dyeing developer containing a sublimation dyeing colorant configured to dye the polymer compound contained in the developer of the first image at a sublimation temperature of the sublimation dyeing colorant; and a transfer section including a transfer roller configured to transfer the first image and the second image on a medium such that the first image and the second image are stacked to each other on the medium.

2. The image formation apparatus according to claim 1, wherein the polymer compound comprises a polyester resin.

3. The image formation apparatus according to claim 1, wherein the medium is an iron-on transfer sheet.

4. The image formation apparatus according to claim 1, wherein the second image formation section includes yellow, magenta, and cyan dyeing developer image formation units configured to form a yellow, magenta, and cyan dyeing developer images, respectively, the second image formation section is configured to form one of the yellow, magenta, or cyan dyeing developer image, such that a weight per unit area of the yellow dyeing developer image on the medium is not less than 0.05 mg/cm$^2$ and not more than 0.43 mg/cm$^2$, a weight per unit area of the magenta dyeing developer image on the medium is not less than 0.10 mg/cm$^2$ and not more than 0.48 mg/cm$^2$, or a weight per unit area of the cyan dyeing developer image on the medium is not less than 0.26 mg/cm$^2$ and not more than 0.45 mg/cm$^2$.

5. The image formation apparatus according to claim 1, wherein, the image formation apparatus is configured to transfer the first image and the second image on the medium in such a manner that the second image and the first image are stacked from below in a recited order on the medium.

6. The image formation apparatus according to claim 5, wherein, the first image formation section is configured to form the first image such that a weight per unit area of the developer of the first image on the medium is not less than 0.12 mg/cm$^2$ and not more than 0.61 mg/cm$^2$.

7. The image formation apparatus according to claim 5, wherein, the first image formation section is configured to form the first image such that a weight per unit area of the developer of the first image on the medium is not less than 0.12 mg/cm$^2$ and not more than 0.36 mg/cm$^2$.

8. The image formation apparatus according to claim 1, wherein, the first image formation section and the second image formation section are arranged in such a manner that the second image and the first image that are transferred to the medium are stacked below in a recited order on the medium.

9. The image formation apparatus according to claim 1, wherein, the transfer section includes:

an intermediate transfer belt on which the first image and the second image are primarily transferred from the first image formation section and the second image formation section, respectively; and a secondary transfer part configured to secondarily transfer the first image and the second image from the intermediate transfer belt to the medium being conveyed.

10. The image formation apparatus according to claim 9, wherein, the first image formation section, the second image formation section, and the secondary transfer part are arranged in a recited order from an upstream side in a running direction of the intermediate transfer belt, such that the first image and the second image are transferred to the medium in such a manner that the second image and the first image are stacked in a recited order from below on the medium.

11. The image formation apparatus according to claim 1, wherein, the transfer section includes:

a transfer part configured to directly transfer the first image and the second image to the medium from the first image formation section and the second image formation section, respectively.

12. The image formation apparatus according to claim 11, wherein, the second image formation section, the first image formation section and the transfer part are arranged in a recited order from an upstream side of a conveyance direction of the medium, such that the first image and the second image are transferred to the medium in such a manner that the second image and the first image are stacked in a recited order from below on the medium.

13. A method of manufacturing a coloring medium comprising:

forming a first image of a developer containing a metallic pigment and a dyeable polymer compound;

forming a second image of a dyeing developer containing a sublimation dyeing colorant configured to dye the polymer compound contained in the developer of the first image at a sublimation temperature of the sublimation dyeing colorant; and transferring the first image and the second image onto a medium such that the first image and the second image are stacked to each other on the medium.

14. The method according to claim 13, further comprising fixing the stack of the first and the second images transferred on the medium to the medium at a fixation temperature which is lower than a sublimation temperature at which the dyeing developer of the second image is sublimated to dye the developer of the first image.

15. The method according to claim 13, wherein an adhesive layer is provided between the medium and the stack of the first and the second images.

16. A method of manufacturing a coloring medium comprising:

forming a first image of a developer containing a lustrous pigment;

forming a second image of a dyeing developer; and transferring the first image and the second image onto a medium such that the first image and the second image are stacked to each other on the medium, wherein an adhesive layer is provided between the medium and the stack of the first and the second images; and performing a final transfer process to transfer the stack of the first and second images via the adhesive layer to a final medium, by applying heat and pressure the stack on the final medium at a sublimation temperature of the dyeing developer of the second image in a state where the adhesive layer is in contact with the final medium, so as to bond the stack of the first and second images via the adhesive layer to the final medium while sublimating the dyeing developer of the second image and thus dying the first image by the sublimated dyeing developer of the second image.

* * * * *